US010985439B2

(12) United States Patent
Fleancu et al.

(10) Patent No.: US 10,985,439 B2
(45) Date of Patent: Apr. 20, 2021

(54) RETAINING AND/OR FASTENING FRAME WHICH IS FORMED ON OR IN A MOBILE-COMMUNICATIONS ANTENNA AND/OR ON OR IN AN ELECTRONIC AND/OR FILTER MODULE, OR WHICH CAN BE FASTENED THEREON, AND AN ASSOCIATED MOBILE-COMMUNICATIONS ANTENNA

(71) Applicant: Telefonaktiebolaget LM Ericsson (publ), Stockholm (SE)

(72) Inventors: Dan Fleancu, Griesstätt (DE); Maximilian Göttl, Frasdorf (DE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 0 days.

(21) Appl. No.: 16/328,964

(22) PCT Filed: Aug. 22, 2017

(86) PCT No.: PCT/EP2017/071145

§ 371 (c)(1),
(2) Date: Feb. 27, 2019

(87) PCT Pub. No.: WO2018/041674

PCT Pub. Date: Mar. 8, 2018

(65) Prior Publication Data

US 2019/0207293 A1 Jul. 4, 2019

(30) Foreign Application Priority Data

Aug. 29, 2016 (DE) ..... 10 2016 116 081

(51) Int. Cl.

| | |
|---|---|
| ***H01Q 1/20*** | (2006.01) |
| ***H01R 13/631*** | (2006.01) |
| ***H01Q 1/24*** | (2006.01) |

(52) U.S. Cl.
CPC ..... *H01Q 1/20* (2013.01); *H01Q 1/246* (2013.01); *H01R 13/6315* (2013.01); *H01R 2201/02* (2013.01)

(58) Field of Classification Search
None
See application file for complete search history.

(56) References Cited

U.S. PATENT DOCUMENTS

| | | | | |
|---|---|---|---|---|
| 5,796,036 | A | 8/1998 | Courtaigne | |
| 2014/0315408 | A1* | 10/2014 | Colapietro | H01R 13/46 439/247 |

(Continued)

FOREIGN PATENT DOCUMENTS

| | | | |
|---|---|---|---|
| CN | 2523033 | Y | 11/2002 |
| CN | 103210551 | A | 7/2013 |

(Continued)

OTHER PUBLICATIONS

International Search Report for PCT/EP2017/071145, dated Oct. 26, 2017, 5 pages.

(Continued)

*Primary Examiner* — Anh Q Tran
(74) *Attorney, Agent, or Firm* — Sage Patent Group

(57) ABSTRACT

A retaining and/or fastening frame (10) which is formed on or in a mobile-communications antenna (1) and/or on or in an electronic and/or filter module (4), or which can be fastened thereon, comprises a frame carrier (11) which is, or can be, fastened for example on a mobile-communications antenna (1). A movable plug-connector-receiving sleeve (12) comprises a housing wall (14), encircling a longitudinal axis (13) of the movable plug-connector-receiving sleeve (12) at least in part, and has two end sides (12*a*, 12*b*) located opposite one another. The encircling housing wall (14) surrounds an accommodating space (15), in which an antenna-side plug connector (9*a*) is, or can be, arranged. A (Continued)

Figure 1:
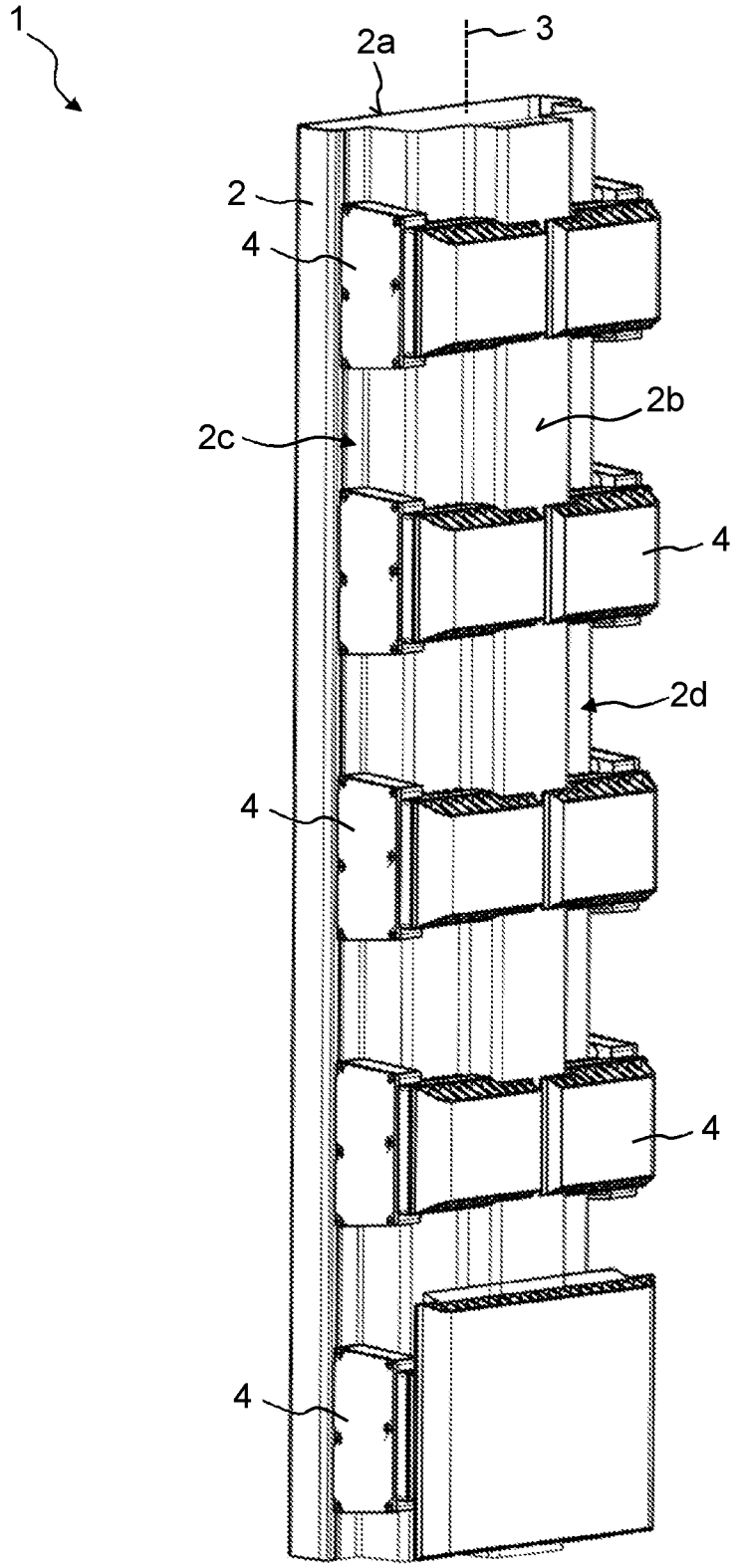

connection port (6*a*) and/or a module-side plug connector (7*a*) of an electronic and/or filter module (4) can be introduced into the accommodating space (15). The movable plug-connector-receiving sleeve (12) is, or can be, connected directly or indirectly to the frame carrier (11) by means of a play-compensation device (16), with an amount of play being permitted, as a result of which the movable plug-connector-receiving sleeve (12) can be moved in relation to the frame carrier (11) in at least one direction transverse to the longitudinal axis (13).

19 Claims, 18 Drawing Sheets

(56) References Cited

U.S. PATENT DOCUMENTS

| | | | | |
|---|---|---|---|---|
| 2016/0104969 | A1 | 4/2016 | An et al. | |
| 2018/0023340 | A1* | 1/2018 | Goldberg | E06B 9/56 160/324 |

FOREIGN PATENT DOCUMENTS

| | | | |
|---|---|---|---|
| CN | 204349085 | U | 5/2015 |
| CN | 104937773 | A | 9/2015 |
| CN | 105161901 | A | 12/2015 |
| DE | 86 04 445 | | 7/1987 |
| DE | 196 10 813 | | 10/1996 |
| DE | 10 2011 113 062 | | 3/2013 |
| DE | 10 2014 000 964 | | 7/2015 |
| EP | 0 722 202 | | 7/1996 |
| JP | 2004303709 | A | 10/2004 |
| WO | 2013/096880 | | 6/2013 |

OTHER PUBLICATIONS

Written Opinion of the ISA for PCT/EP2017/071145, dated Oct. 26, 2017, 7 pages (non-English).

English translation of the International Preliminary Report on Patentability and Written Opinion of the International Searching Authority dated Mar. 14, 2019, issued in International Application No. PCT/EP2017/071145, 9 pages.

CNIPA Searh Report for corresponding CN201780053334.7, dated Jun. 19, 2020.

* cited by examiner

RETAINING AND/OR FASTENING FRAME WHICH IS FORMED ON OR IN A MOBILE-COMMUNICATIONS ANTENNA AND/OR ON OR IN AN ELECTRONIC AND/OR FILTER MODULE, OR WHICH CAN BE FASTENED THEREON, AND AN ASSOCIATED MOBILE-COMMUNICATIONS ANTENNA

This application is the U.S. national phase of International Application No. PCT/EP2017/071145 filed 22 Aug. 2017, which designated the U.S. and claims priority to DE Patent Application No. 10 2016 116 081.4 filed 29 Aug. 2016, the entire contents of each of which are hereby incorporated by reference.

The invention relates to a retaining and/or fastening frame which is formed on or in a mobile-communications antenna and/or in an electronic and/or filter module, or which can be fastened thereon, and to a mobile-communications antenna on which at least one or preferably at least two such retaining and/or fastening frames are mounted.

An active mobile-communications antenna may, for example, consist of an antenna and one or more remote radio heads (RRH), which may be mounted on the antenna (semi-active antenna) or be integrated and/or firmly connected to the antenna (active antenna). The term "remote radio head" refers to the outdoor, weatherproof assembly of power supply, transmission and reception module (transceiver), power amplifier and duplex filter on the antenna mast. The communication with a base station is generally performed through a digital interface such as a glass fiber connection. The mobile-communications antenna, which in combination with the remote radio heads may also be referred to as a (semi-)automatic antenna, comprises a plurality of emitters or emitter pairs furnished with a radio unit (amplifier unit) and/or which are supplied by said unit. In mobile-communications antennas, there are significant power losses due to the low effectiveness of the amplifiers and the very time-consuming signal processing in the digital component. The achievable effectiveness of these types of mobile-communications antennas is approximately 20% to 30%. This means that 70%-80% of the electrical power supplied must be discharged again, preferably as heat. This requires higher cooling effort, which increases the weight and costs. In addition, the surrounding temperatures at which the mobile-communications antennas are used may range from −40° C. to +55° C. Accordingly, components (such as FPGAs) for the digital signal processing and power amplifiers (chips) must be able to handle these temperature ranges. These days, active mobile-communications antennas have a very compact design, and all the functional units, such as the power amplifiers (PA), processor units (TRX board), filters, A/D and/or D/A converters, are therefore arranged in the tightest of spaces.

When one of these components fails, all the functional units or the entire mobile-communications antenna must be replaced. Such a replacement requires the mobile-communications antenna to be shut off completely. Often, it is not possible to continue to operate the antenna with the still functioning functional units.

Furthermore, the functional units are arranged on or in the mobile-communications antenna in such a way that the entire antenna must be taken down and the functional units preferably exchanged at ground level. Subsequently, the antenna is put up again. Since the mobile-communications antennas are very heavy, often corresponding crane devices are necessary, which are difficult to use, particularly in inaccessible areas.

It is therefore desirable that the components that are prone to failure can be replaced as easily as possible. In this case, the mobile-communications antenna should stay on the mast. This means that a technician must replace the active components at a great height. These are therefore preferably arranged outside the antenna housing so that said housing does not have to be opened. The active components to be replaced should therefore be easy to detach, and it should be possible to attach the new components as easily as possible.

One problem is that the active components have a plurality of plugs that are offset from each other. Due to the fact that the location and orientation of these plugs are subject to tolerances, and that the technician must perform the replacement at a great height, it is desirable that the new active components and their plugs can be brought in contact with the counterparts of the plugs provided on the mobile-communications antenna as easily as possible.

Such an easy connection possibility does not currently exist for mobile-communications antennas. Only in the field of circuit boards have some rudimentary ideas been generated about how a plug connector in the form of a plug can be electrically connected to another plug connector in the form of a female connector, when certain tolerances have to be maintained regarding production and/or orientation. In this regard, EP 0 722 202 A2 states that a coaxial plug connector having an inner and an outer conductor should be arranged in a stationary housing so that the inner conductor with its outer conductor can be tilted relative to this housing, which makes it easier to establish a plug connection.

A disadvantage of EP 0 722 202 A2 is that the configuration of the coaxial contacting means is complicated and that it is only suitable for coaxial cables having just one inner conductor. It would not be possible to use these coaxial contacting means in antennas, some of which are installed several hundreds of meters above the ground and must be able to withstand wind and weather.

It is therefore the object of the present invention to create a retaining and/or fastening frame which can be mounted on the mobile-communications antenna and an associated mobile-communications antenna comprising at least one or more of said retaining and/or fastening frames. The retaining and/or fastening frames are to provide means with which components in a mobile-communications antenna that are prone to failure can easily and safely be replaced.

The object is achieved by the retaining and/or fastening frame according to the invention to be mounted on mobile-communications antennas in accordance with independent claim 1. The object with regard to the mobile-communications antenna comprising at least one or more retaining and/or fastening frames is achieved by claim 24. Claims 2 to 23 provide developments of the retaining and/or fastening frame according to the invention. Claims 25 to 27 describe developments of the mobile-communications antenna according to the invention.

The retaining and/or fastening frame according to the invention is formed on or in a mobile-communications antenna and/or on or in an electronic and/or filter module or can be fastened thereon. It comprises a frame carrier which is, or can be, fastened for example on a mobile-communications antenna. Such a fastening is preferably provided by a screw connection. In the case of an indirect fastening, the frame carrier is fastened to the mobile-communications antenna by means of another component. In the case of a direct connection, the frame carrier is fastened directly to the mobile-communications antenna. Furthermore, at least one movable plug connector receiving sleeve is provided, which comprises a housing wall encircling a longitudinal axis of the movable plug connector receiving sleeve and which has two end sides located opposite one another, the first end side forming the sleeve insertion opening and the second end side forming the sleeve bottom side. The encircling housing wall surrounds an accommodating space, in which an antenna-side plug connector is, or can be, arranged. The sleeve insertion opening is used to accommodate a connection port of an electronic and/or filter module. A further module-side plug connector is preferably arranged in or on this connection port. A plug connection can be produced by means of the two plug connectors. The movable plug connector receiving sleeve is movably positioned on the frame carrier and is, or can be, connected directly or indirectly to the frame carrier by means of a play compensation device with an amount of play being permitted, as a result of which the movable plug connector receiving sleeve can be moved in relation to the frame carrier in at least one direction transversely to the longitudinal axis. This means that the play compensation device is arranged and/or formed or designed such that the play provided permits a relative movement of the movable plug connector receiving sleeve with respect to the frame carrier. The plug connector receiving sleeve is movable in this case with a movement vector relative to the frame carrier. This movement vector may extend in any direction transversely to the (starting) longitudinal axis of the movable plug connector receiving sleeve. This also makes slightly circular movements possible with which the plug connector receiving sleeve can be moved around the (starting) longitudinal axis, i.e., around a central location or starting location.

It is important that the (im)movable plug connector receiving sleeve, on the one hand, can comprise the antenna-side plug connector in order to accommodate the connection port and/or the module-side plug connector. In this case, the retaining and/or fastening frame together with the (im)movable plug connector receiving sleeve are arranged on or in the mobile-communications antenna or the antenna housing.

On the other hand, the retaining and/or fastening frame may be formed together with the (im)movable plug connector receiving sleeve such that it is arranged and/or formed on or in the electronic and/or filter module. In this case, the (im)movable plug connector receiving sleeve comprises the connection port and/or the module-side plug connector and can accommodate the antenna-side plug connector.

To provide a better overview, the preferred embodiments below only describe the case where the retaining and/or fastening frame is formed and/or is fastened and/or can be fastened to a mobile-communications antenna. In this case, the movable plug connector receiving sleeve comprises the antenna-side plug connector, wherein the module-side plug connector can be inserted into it.

This makes it possible to compensate for manufacturing tolerances. This applies especially when the electronic and/or filter module has several connection ports. These connection ports do not always have to be arranged on the electronic and/or filter module at exactly the same location with the same orientation. The connection port may, for example, be a cast part, which is an integral component of the housing of the electronic and/or filter module. In this case, depending on the casting method used, there may be some manufacturing tolerances. To enable a technician to safely replace the electronic and/or filter module at a great height, the play compensation device ensures that the plug connector receiving sleeve can move into the correct position so that the corresponding connection port of the electronic and/or filter module can be inserted into it.

The play compensation device can be realized in several ways. In a simpler embodiment, the movable plug connector receiving sleeve may be connected to the frame carrier by means of a resilient connecting member. In a preferred embodiment, the play compensation device comprises a suspension device and a fastening device. The suspension device is connected to the frame carrier or formed thereon. Preferably, the frame carrier and the suspension device are formed in one piece (made from a single workpiece). The fastening device, however, is arranged or formed on the movable plug connector receiving sleeve, in particular on the encircling housing wall of the movable plug connector receiving sleeve. Here as well, a one-piece configuration of the fastening device and the movable plug connector receiving sleeve would be possible. The suspension device comprises at least two retaining portions arranged at a distance from each other, space being created between said portions in which the movable plug connector receiving sleeve is arranged. The fastening device comprises at least two fastening clips, wherein each fastening clip comprises an opening having a first diameter. The retaining portions of the suspension device, however, each have one retaining clip, wherein the retaining clips also comprise an opening having a second diameter. Preferably, the two diameters differ from each other. A first connecting means, in particular in the form of a screw connection, passes through the opening of the first fastening clip and the opening of the first retaining clip. A second connecting means, in particular in the form of a screw connection, passes through the opening of the second fastening clip and the opening of the second retaining clip. A diameter of the connecting means, in particular of a screw body of each screw connection, is smaller than the first diameter of the fastening clips, as a result of which these are positioned and/or arranged on the respective retaining clip with some play. The connecting means, i.e., preferably the screw body, preferably has a diameter that corresponds to the second diameter of the opening of the retaining clips. The screw body should preferably create a mechanical connection (e.g., force fit) with the retaining clips. The use of such a play compensation device makes it possible that the movable plug connector receiving sleeve can be moved relative to the frame carrier so that the resulting movement vector runs vertically or, with one component, substantially vertically to the longitudinal axis. The movable plug connector receiving sleeve is therefore, due to this configuration, preferably without play in the longitudinal direction relative to the frame carrier.

In a preferred embodiment, the fastening clips are located closer to the first end side of the movable plug connector receiving sleeve than to the second end side. This achieves good stability when the connection port is plugged into the movable plug connector receiving sleeve.

To facilitate the insertion of the connection port into the movable plug connector receiving sleeve, said sleeve has, in another preferred embodiment, at least one portion that extends in the direction of the longitudinal axis to the first end side in which the diameter of the movable plug connector receiving sleeve increases. Even if mention is made here of a diameter, the accommodating space of the movable plug connector receiving sleeve does not have to be round in cross section. This is the preferred shape, but the cross section may also deviate from a round shape and may, for example, have the shape of an oval, be rectangular, or generally n-polygonal. The cross section may also change along the longitudinal axis.

To improve the guidance of the connection port and also the orientation of the connection port within the movable plug connector receiving sleeve, said guidance comprises, in a further preferred embodiment, at least one or at least two or at least three receiving slots which extend across part of the length of the movable plug connector receiving sleeve and run parallel or, with one component, substantially parallel to the longitudinal axis. The receiving slots are formed to guide the connection port and/or the module-side plug connector of the electronic and/or filter module, wherein protrusions on a peripheral wall of the connection port and/or of the module-side plug connector engage or can engage in these receiving slots. These receiving slots may penetrate the surrounding housing wall. In the region of the receiving slots, the surrounding housing wall may also only have a greater inner diameter and/or the wall thickness of the surrounding housing wall may be less in the region of the receiving slots through which it is formed. In this case, the surrounding housing wall would be completely closed.

Conversely, it would likewise be possible, of course, that the movable plug connector receiving sleeve comprises at least one or at least two or at least three guiding ridges that extend across part of the length of the movable plug connector receiving sleeve at its inner circumferential wall in the direction of the accommodating space and parallel or, with one component, substantially parallel to the longitudinal axis. In this case, the connection port and/or the module-side plug connection would comprise corresponding grooves. The guiding ridges would then engage in these grooves.

In a further preferred embodiment, the receiving slots extend to the first end side of the movable plug connector receiving sleeve and are accessible from the insertion opening and end at a distance from the second front end. Preferably, the surrounding housing wall is, however, completely closed in the region of the first end side. In this case, only the inner diameter would increase in the region of the receiving slots so that these are accessible from the end side, i.e., from the sleeve insertion opening.

The receiving slots preferably widen toward the first end side and thus act as a centering aid. This may be the case for the guiding ridges in the same way. These could, in terms of their width and/or height (the extent to which they protrude into the accommodating space), taper in the direction of the first end side so that they can easily be inserted into the grooves of the connection port and/or the module-side plug connector. The grooves on the connection port and/or on the module-side plug connector may widen correspondingly at their ends as well.

In a particular embodiment of the invention, the retaining and/or fastening frame comprises at least one length compensation means. The at least one length compensation means comprises a front end side and a back end side and is arranged in the accommodating space of the movable plug connector receiving sleeve. The length compensation means is arranged here directly at and/or closer to the second end side of the movable receiving sleeve than to the first end side of the movable plug connector receiving sleeve. It is formed so that the plug connector that is or can be arranged inside the accommodating space is movable along the longitudinal axis in the direction of the second end side or away from the second end side. The length compensation means is preferably resilient, for example in the form of bellows. Preferably, it consists of or comprises plastics material or rubber. Other resilient materials may also be used. In principle, it could also consist of a (metal) tongue. The diameter of the length compensation means changes preferably across its length. In this case, the length compensation means would, in the relaxed state, lie against an inner wall of the movable plug connector receiving sleeve at the most with a part of its peripheral surface. In the case that the length compensation means is in the relaxed state, the antenna-side plug connector arranged in the accommodating space would be arranged at the furthest distance from the second end side. If now the connection port and therefore the module-side plug connector is inserted through the insertion opening into the accommodating space of the movable plug connector receiving sleeve, it can plug into the antenna-side plug connector, which is already in the accommodating space, further in the direction of the second end side of the movable plug connector receiving sleeve. This can take place before the plug connection is created or afterwards. This makes it possible to compensate for tolerances that form along the longitudinal axis. As soon as the plug connection is severed and the module-side plug connector is removed again, the length compensation means expands again and the antenna-side plug connector is pushed in the direction of the first end side of the movable plug connector receiving sleeve.

In a preferred embodiment, the length compensation means is completely penetrated by a recess. This recess preferably runs along or parallel to the longitudinal axis. The antenna-side plug connector and/or a connection cable of the plug connector can or is accommodated in this recess.

In another preferred embodiment, the recess that penetrates the length compensation means comprises at the exit from the front end side a first coded shape, the antenna-side plug connector comprising a corresponding shape along at least an insertion length. This ensures that the antenna-side plug connector is or can be inserted into the recess of the length compensation means only in a certain direction and/or at a certain angle and that, when inserted, it cannot rotate at all or only up to a certain angular position (e.g., less than 2°, less than 1°, less than 0.5°) relative to the length compensation means.

Such a coded shape could be provided another time as well. In another embodiment of the invention, the second end side of the movable plug connector receiving sleeve is opened only in part, the opening comprising a second coded shape. The back end side of the length compensation means comprises a protrusion here through which the recess exits. This protrusion of the length compensation means has in this case a shape that corresponds to the second coded shape of the opening so that the length compensation means is or can be inserted only in a certain direction and/or angular position into the opening of the second end side of the movable plug connector receiving sleeve. Preferably, the length compensation means cannot rotate at all or only about a certain, very small, angular position (less than 2°, less than 1°, less than 0.5°) relative to the movable plug connector receiving sleeve. The same also applies for the plug connector which is arranged in the accommodating space of the movable plug connector receiving sleeve. This preferably cannot rotate at all or only in a very small angular range (less than 2°, less than 1°, less than 0.5°) relative to the length compensation means.

In another embodiment, tolerances in the length of the connection port can be compensated by placing at least one resilient compression means between the first fastening clip and the first retaining clip and by placing at least one second resilient compression means between the second fastening clip and the second retaining clip. In this way, the movable plug connector receiving means is movable along the longitudinal axis. The resilient compression means is formed so that it wants to increase the distance between the fastening clips and the retaining clips, wherein force has to be applied to compress the resilient compression means. Such a force would be generated by the insertion of the connection port and/or the module-side plug connector into the movable plug connector receiving sleeve.

In a further embodiment of the retaining and/or fastening frame, said frame comprises at least one further movable plug connector receiving sleeve. The at least two movable plug connector receiving sleeves are, when viewed from above, laterally offset from each other (X-direction and/or Y-direction) and arranged consecutively (Z-direction, i.e., in the longitudinal direction) in an offset manner. Due to the insertion of the movable plug connector receiving sleeves, it is no problem to connect an electronic device having two connection ports and the respective corresponding module-side plug connectors having the antenna-side plug connectors inside the plug connector receiving sleeves.

In principle, it would also be possible for the retaining and/or fastening frame to preferably comprise exactly one immovable plug connector receiving sleeve. This immovable plug connector receiving sleeve is connected firmly and without play to the frame carrier. The immovable plug connector receiving sleeve also comprises two opposing end sides, a first end side forming and/or representing the sleeve insertion opening and the opposite second end side forming the sleeve bottom side of the immovable plug connector receiving sleeve. An encircling housing wall of the immovable plug connector receiving sleeve surrounds an accommodating space in which a further antenna-side plug connector is arranged or can be arranged. The sleeve insertion opening of the immovable plug connector receiving sleeve serves here once again for the accommodation of a further connection port and/or a further module-side plug connector of the electronic and/or filter module. The immovable plug connector receiving sleeve and the at least one movable plug connector receiving sleeve are, when seen from the above, either laterally offset from each other or laterally and consecutively offset from each other.

Such an immovable plug connector receiving sleeve may be produced in a very cost-efficient manner. In the interaction with a movable plug connector receiving sleeve, the connection ports and/or the module-side plug connector of the electronic and/or filter module may be securely inserted therein for the creation of a plug connection. It should be emphasized that, in the case of two or more plug connector receiving sleeves, at least one of these sleeves is immovable whereas all the other sleeves are movable.

In another preferred embodiment of the retaining and/or fastening frame, an antenna-side plug connector is arranged in the movable plug connector receiving sleeve. This antenna-side plug connector comprises a connection side and an opposing cable side. The connection side is oriented in the direction of the insertion opening of the movable plug connector receiving sleeve. The insertion side comprises at least one or at least two or at least three connection contacts (plugs or female connectors), which can be connected to the corresponding connection contacts (female connectors or plugs), which are arranged in the module-side plug connector in and/or on the connection port of the electronic and/or filter module.

The connection side preferably comprises in a further embodiment a centering pin or a centering opening. This centering pin extends from the connection side of the antenna-side plug connector further in the direction of the insertion opening. The centering pin or the centering opening is preferably formed in the center of the connection side. The centering pin preferably comprises at its end a tapering, in particular conical, progression. The centering opening comprises at its end, which preferably coincides with the end side of the connection side, a bigger diameter than in its remaining extension within the (module-side or antenna-side) plug connector. If a plug connection is formed by two plug connectors, one of these plug connectors preferably comprises the centering pin and the other plug connector preferably the centering opening.

In a further embodiment, one of the plug connectors comprises a push-in sleeve, which protrudes from the connection side and covers the connections. In an inner wall of this push-in sleeve, a protrusion (also referred to as a tongue) is arranged which extends across a certain length toward the inside, preferably radially. The corresponding plug connector comprises a groove at its peripheral wall with which the protrusion, i.e., the tongue, engages.

The plug connectors are preferably radially asymmetrical. In principle, they may be radially symmetrical as well.

The mobile-communications antenna according to the invention is used for fastening to a mast or wall-shaped carrier and comprises at least one or at least two or at least three retaining and/or fastening frames. The mobile-communications antenna comprises an antenna housing having a housing front side, a housing back side, and a first and a second lateral housing side arranged opposite each other which together form a surrounding housing wall, the antenna housing extending along a longitudinal axis. A plurality of emitters or emitter pairs are arranged in the antenna housing in front of at least one reflector. At least one or more of the retaining and/or fastening frames are mounted on the antenna housing. An antenna-side plug connector is arranged in the accommodating space of the at least one movable plug connector receiving sleeve of the respective retaining and/or fastening frame. A connection cable of the antenna-side plug connector leads to the inside of the antenna housing. It is particularly advantageous that an electronic and/or filter module can therefore be mounted very easily on the outer side of the antenna housing.

Preferably, the retaining and/or fastening frame also comprises at least one immovable plug connector receiving sleeve, in which an antenna-side plug connector is arranged as well.

In a further embodiment, the mobile-communications antenna comprises at least one or at least two or at least three electronic and/or filter modules which are accommodated in separate housings. The at least one or the at least two electronic and/or filter modules comprise at least a first connection port with a first module-side plug connector which is arranged within the first or on the first connection port or which forms said connection port. Optionally, there is also a second connection port with a second module-side plug connector. The at least one electronic and/or filter module or the at least two electronic and/or filter modules are arranged on the at least one or on the at least two retaining and/or fastening frames and are furthermore fastened or mounted on the housing back side and/or the first or second lateral housing side outside of the antenna housing. Preferably, the precisely one retaining and/or fastening frame is used to accommodate precisely one electronic and/or filter module. It would also be possible that two or more than two electronic and/or filter modules can be fastened to a retaining and/or fastening frame. The at least one first connection port and/or the first module-side plug connector are inserted here in the accommodating space of the movable plug connector receiving sleeve. This applies even when the electronic and/or filter module has more than one connection port. In this case, preferably every connection port with the corresponding module-side plug connector would be inserted in a corresponding accommodating space of a movable and/or immovable plug connector receiving sleeve. Here, a first plug connection is formed in that the first module-side plug connector in and/or on the first connection port makes contact with the antenna-side plug connector in the accommodating space of the movable plug connector receiving sleeve. In the case where a plurality of connection ports are used, further plug connections can be formed, a plug connection being formed between a module-side plug connector in and/or on a further connection port and an antenna-side plug connector in the immovable plug connector receiving sleeve.

In this way, it is very easy to form a reproducible electric and/or optical connection between the electronic and/or filter module and the mobile-communications antenna by means of the corresponding module-side and antenna-side plug connectors.

The electronic and/or filter module is preferably an amplifier module. It may also, however, be a signal-processing module or a control unit or a voltage supply unit. Different electronic and/or filter modules may be fastened to the mobile-communications antenna at the same time.

Figure 4:
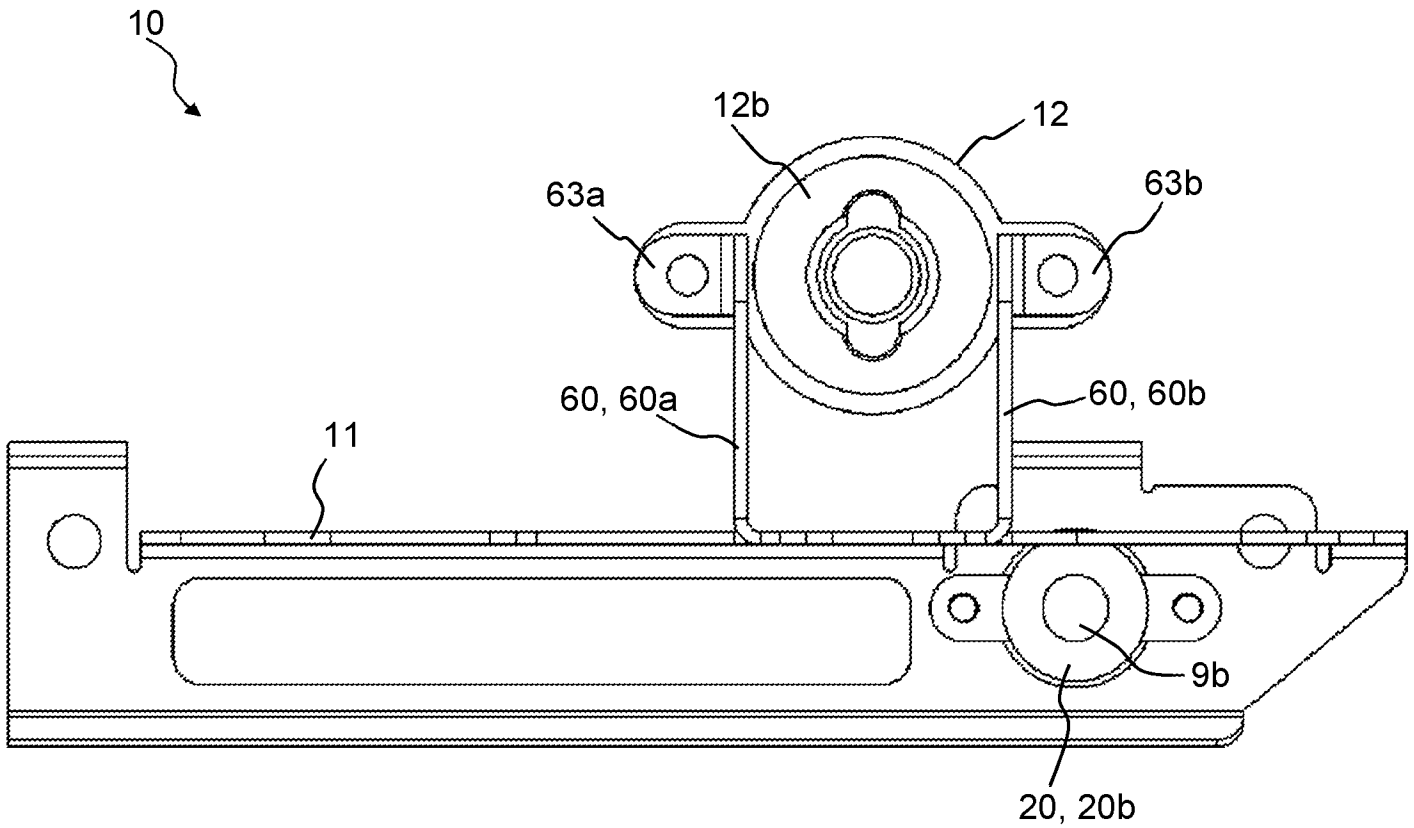
Figure 5:
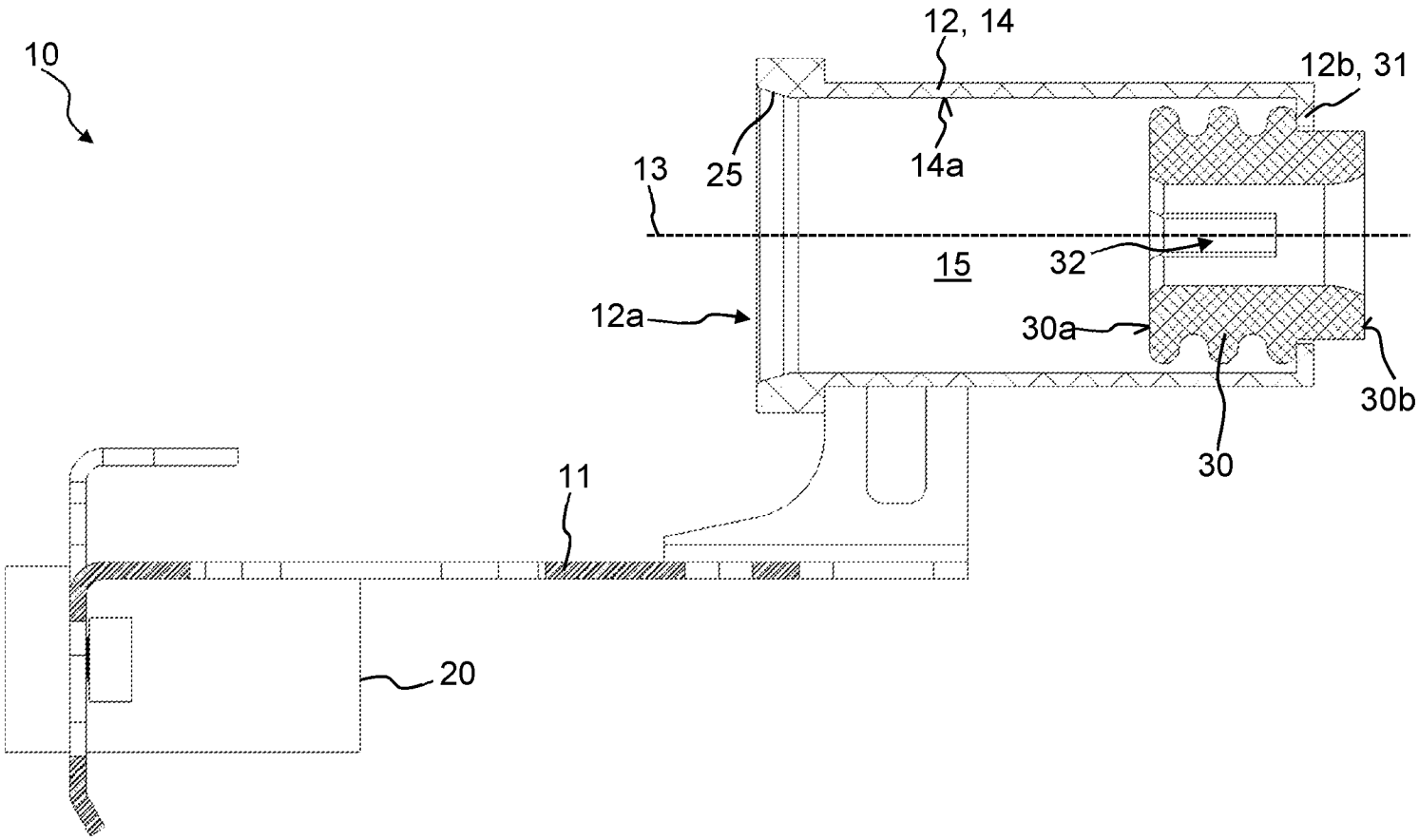
Figure 9:
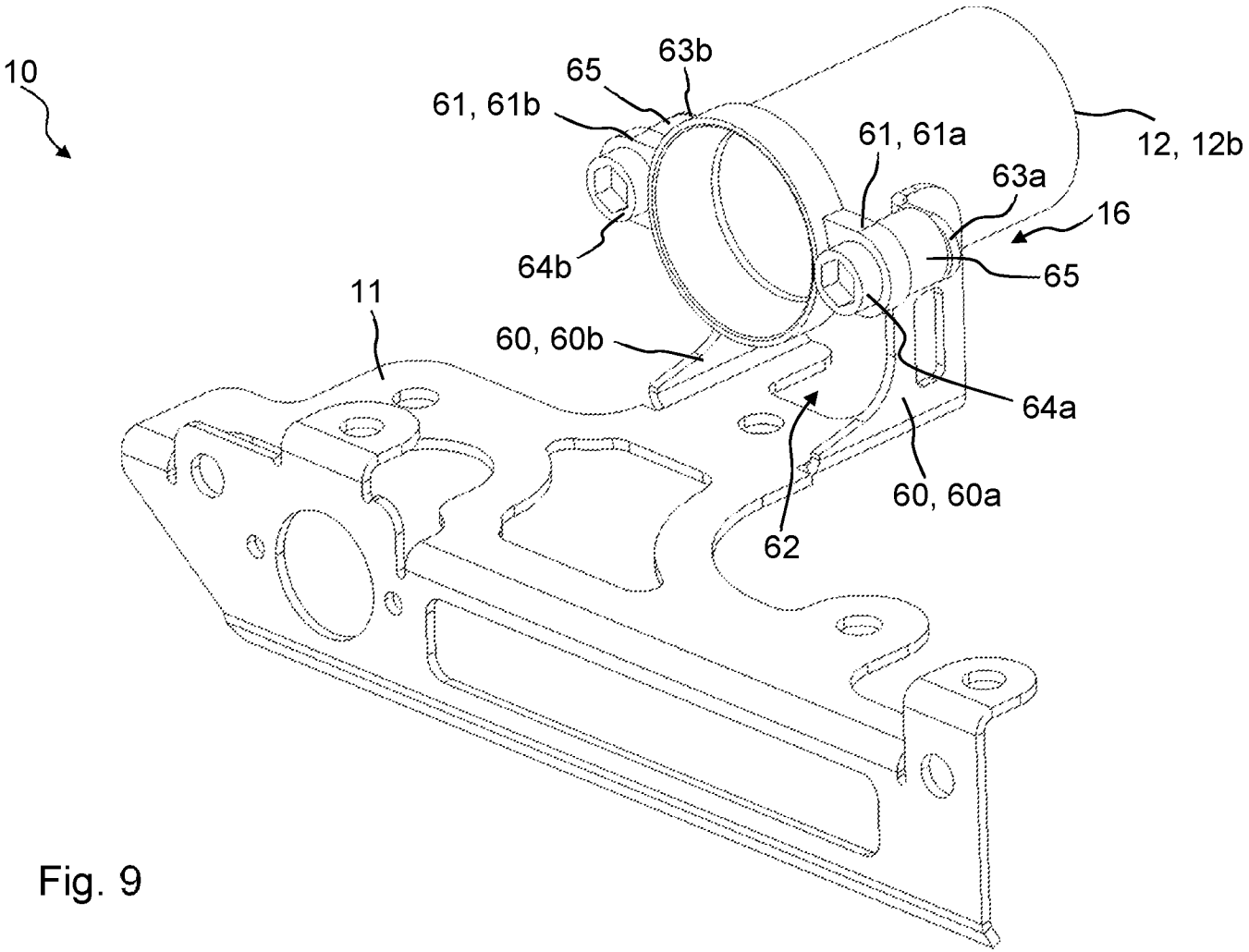
Figure 13:
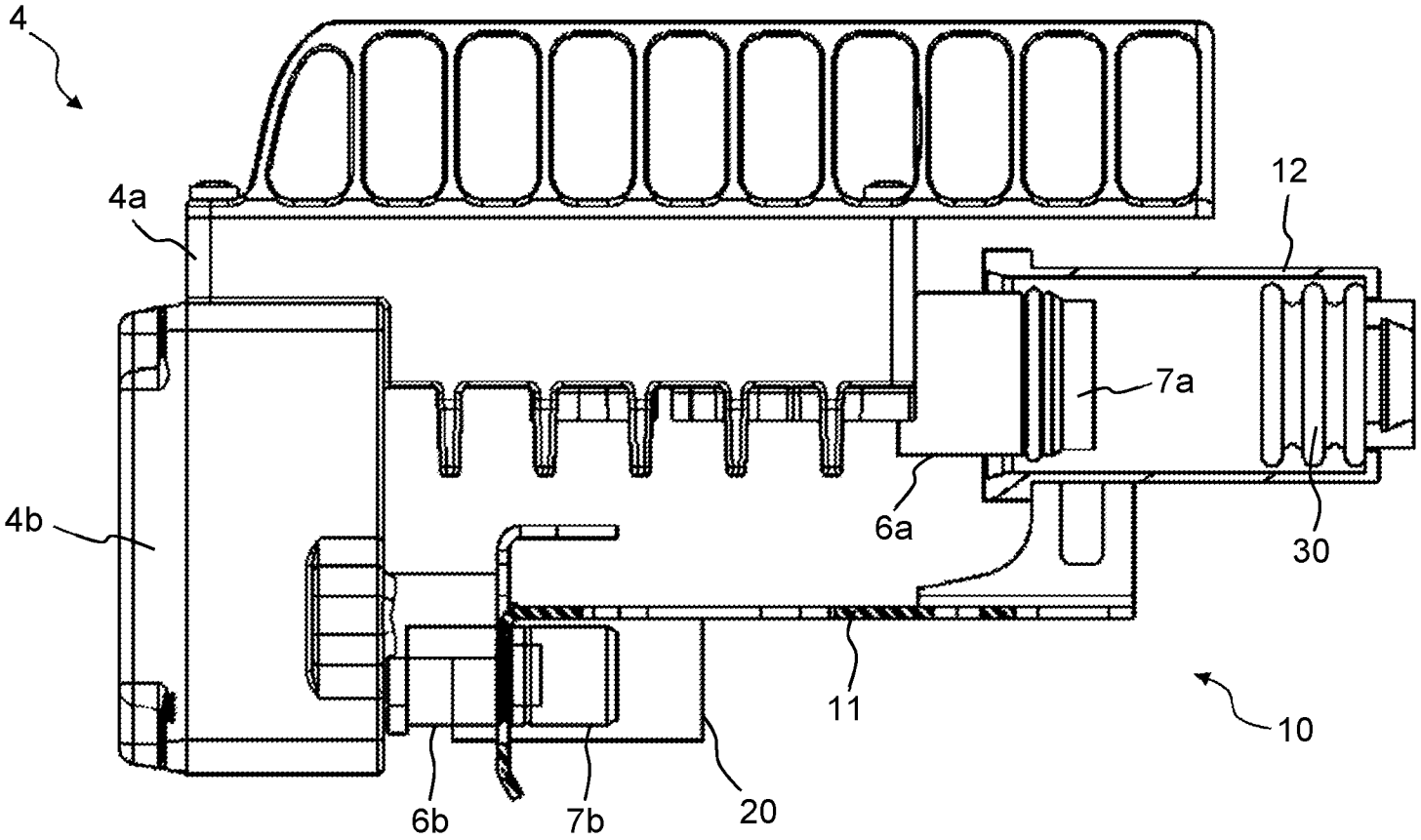

Various embodiments of the invention are described below by way of example with reference to the drawings. The same objects have the same reference signs. In detail, in the corresponding drawings:

FIG. 1: is a spatial view of a mobile-communications antenna according to the invention with a plurality of retaining and/or fastening frames on which electronic and/or filter modules are arranged;

FIG. 2A, 2B:

are spatial views of an electronic and/or filter module with two connection ports each, which can be connected to the mobile-communications antenna by means of retaining and/or fastening frames;

FIG. 3A to 3C:

are various spatial views of the retaining and/or fastening frame according to the invention;

FIG. 4: is a rear view of an embodiment of the retaining and/or fastening frame according to the invention;

FIG. 5: is a longitudinal sectional view through the retaining and/or fastening frame according to the invention;

FIG. 6A to 6C:

are various views of a movable plug connector receiving sleeve;

FIG. 7A, 7B:

are different spatial views of a length compensation means;

FIG. 8A, 8B:

are different views of another embodiment of the movable plug connector receiving sleeve;

FIG. 9: is a spatial view of the retaining and/or fastening frame according to the invention, wherein the length compensation means is arranged outside the movable plug connector receiving sleeve;

FIG. 10A, 10B:

show different embodiments of the retaining and/or fastening frame according to the invention that explain how the play compensation device can be configured;

FIG. 11A, 11B:

are exploded spatial views which explain how the plug connectors and the length compensation element interact with the retaining and/or fastening frame according to the invention and the electronic and/or filter module;

FIG. 12A, 12B:

are different spatial views of the retaining and/or fastening frame according to the invention, wherein the electronic and/or filter module has been accommodated; and FIG. 13: is a simplified view of a longitudinal section through the electronic and/or filter module and the retaining and/or fastening frame, wherein the electronic and/or filter module is arranged in the retaining and/or fastening frame.

FIG. 1 is a spatial view of the mobile-communications antenna 1 according to the invention. The mobile-communications antenna 1 according to the invention can be attached to a mast-shaped or wall-shaped carrier. Its purpose is to provide different communications standards for mobile terminals. The mobile-communications antenna 1 comprises at least one antenna housing 2 having a housing front side 2*a*, a housing back side 2*b*, and a first and an opposing, second lateral housing side 2*c*, 2*d* which together form a surrounding housing wall. In this case, the antenna housing 2 runs along a housing longitudinal axis 3.

A plurality of emitters or emitter pairs are arranged in the antenna housing 2 in front of at least one reflector. These emitters or emitter pairs are part of a preferably dipole-shaped emitter assembly. The dipole-shaped emitter assembly may comprise two pairs of emitter halves which are to be arranged at a 90° angle from each other so that the dipole-shaped emitter assembly emits and/or receives in two polarization planes that are vertical to each other. The emitter halves, i.e., the two emitter pairs, are oriented in an emitter plane that extends preferably parallel to the reflector. The emitters or emitter pairs furthermore comprise a symmetry and/or carrier assembly comprising a first end and a second end, the second end being located opposite the first end. The emitters or emitter pairs are arranged on the first end of the symmetry and/or carrier assembly. The second end of the symmetry and/or carrier assembly is fastened to the reflector. The dipole-shaped emitter assembly is preferably formed as a vector dipole, a cross dipole, or a dipole square.

The emitter or emitter pairs are arranged inside the antenna housing 2 so that they emit their mobile-communications signals through the housing front side 2*a* and, if applicable, at least in part through the first or second lateral housing side 2*c*, 2*d*.

The first and the second lateral housing sides 2*c*, 2*d* are preferably formed in a stepped manner and each comprise m side segments with m≥2 or m≥3. The first side segment of the first and second lateral housing side 2*c*, 2*d* connects to the housing front side 2*a*. In contrast, the m-th side segment of the first and second lateral housing side 2*c*, 2*d* connects to the housing back side 2*b*. The term "connect" refers to a one-piece or multi-piece connection, for example involving a mechanical force fit such as a screw connection, for example.

A distance between the respective side segments of the first and the second lateral housing side 2*c* decreases preferably successively from the first side segment to the m-th side segment. The individual side segments are interconnected via connection segments. These connection segments run preferably parallel to the reflector, or preferably parallel or, with one component, substantially parallel to the housing front side 2*a* and/or the housing back side 2*b* of the antenna housing 2. In principle, these connection segments or the lateral housing sides 2*c* may also run in a slanted, i.e., a non-orthogonal, manner toward the reflector, e.g., at a 45° angle.

Due to the fact that the antenna housing 2, when viewing its cross section from above, comprises stepped and/or zigzag-shaped or slanted lateral housing sides 2*c*, 2*d*, accommodating spaces are formed for further modules, in particular for electronic and/or filter modules 4. These further electronic and/or filter modules 4 or functional units may be connected by means of corresponding connection openings to components within the antenna housing 2 and fastened to the antenna housing 2. For this purpose, the first and/or second lateral housing side 2*c*, 2*d* comprises, preferably on two different side segments, at least two connection openings to which a plug connector 5*a*, 5*b* is assigned.

As already mentioned, the antenna housing 2 could generally taper from the housing front side 2*a* to the housing back side 2*b*. When viewing the cross section of the antenna housing 2 from above, the first and/or the second lateral housing side 2*c*, 2*d* runs in at least a subregion from the housing front side 2*a* to the housing back side 2*b* with one component in the direction of the opposite lateral housing side 2*c*, 2*d*. As a result, the housing back side 2*b* preferably has a smaller width than the housing.

The slanted or stepped contour of the first or second lateral housing side 2*c*, 2*d* may extend across the entire length of the antenna housing 2 or across a correspondingly shorter part of the length. In this case, this contour is preferably provided in the middle region of the antenna housing 2.

The plug connectors 9*a* (see FIG. 11A) arranged on the antenna housing 2 are used to connect the emitters or emitter pairs by means of an amplifier to the at least one signal-processing and/or control unit, which is also part of the mobile-communications antenna 1. Such an amplifier between the emitters or emitter pairs and the signal-processing and/or control unit is arranged and/or integrated in particular in at least one of the electronic and/or filter modules 4. Preferably, at least two amplifier modules, and therefore electronic and/or filter modules 4, are used per band, wherein the signal transmission on a band should still be ensured even if an electronic and/or filter module 4 malfunctions. The at least one electronic and/or filter module 4 can be attached or is attached at the outside of the antenna housing 2. The at least one electronic and/or filter module 4 preferably forms a transmission amplifier which amplifies mobile communications signals that are transmitted by the emitters or emitter pairs. In principle, the electronic and/or filter module 4 could comprise a receiving amplifier as well.

The at least one electronic and/or filter module 4 or the electronic and/or filter modules 4 is/are attachable to the antenna housing 2 with respect to the first and/or the second lateral housing side 2*c*, 2*d*. Preferably, the at least one electronic and/or filter module 4 can be attached and detached without the use of tools. This means that no screw connections have to be loosened if necessary using a tool. Tool-free attachment and detachment of the at least one electronic and/or filter module 4 from the antenna housing 2 is an invaluable advantage to a technician working at a great height.

Preferably, the at least one electronic and/or filter module 4 can be attached to the antenna housing 2 or detached therefrom with a motion vector that runs exclusively vertically or, with one component, substantially vertically to the first or the second lateral housing side 2*c*, 2*d* and/or that runs parallel or, with one component, substantially parallel to the reflector plane of the reflector. In the top view onto the housing front side 2*a* of the antenna housing 2, the at least one electronic and/or filter module 4 is, when mounted, preferably completely covered by the housing front side 2*a*.

FIG. 1 shows that the mobile-communications antenna 1 comprises a plurality of electronic and/or filter modules 4. The electronic and/or filter modules 4 are arranged at a distance from each other on the first lateral housing side 2*c* and on the second lateral housing side 2*d* along the housing longitudinal axis 3. The electronic and/or filter modules 4 that are attached to the first lateral housing side 2*c* preferably have no mechanical contact (i.e., are contact free) with the electronic and/or filter modules 4 that are attached to the second lateral housing side 2*d*.

Figure 2B:
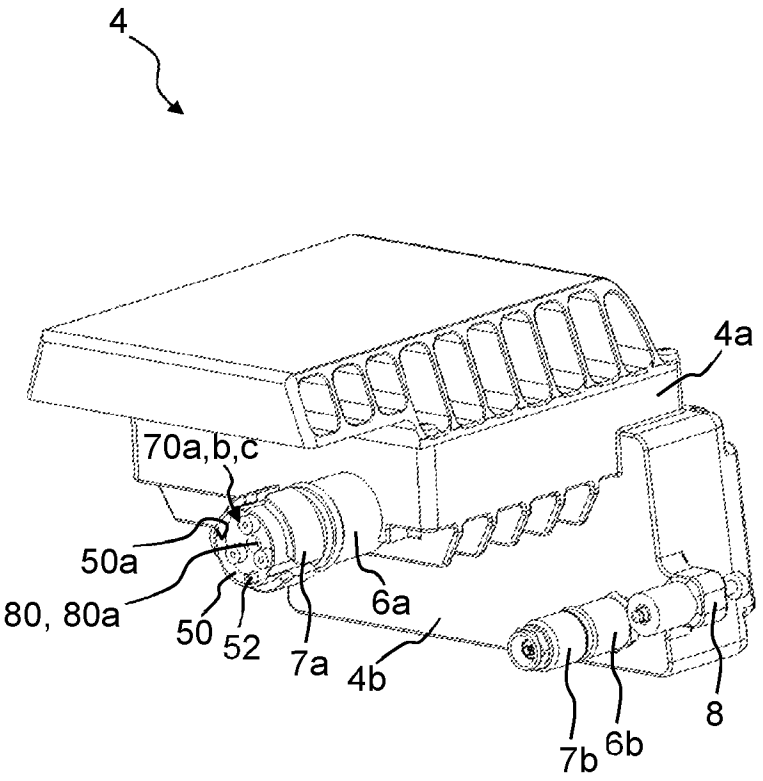
Figure 2A:
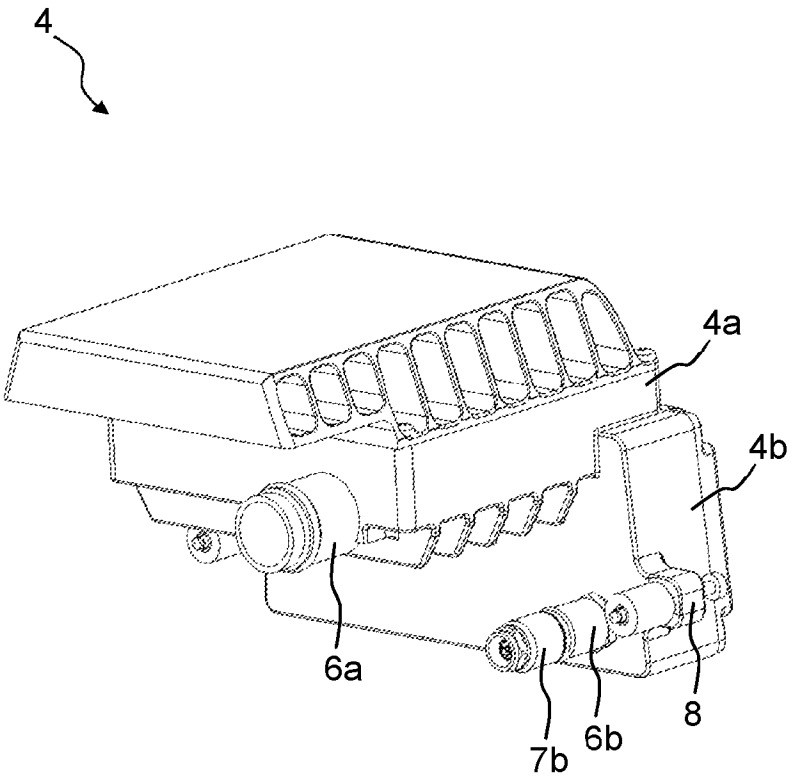

The electronic and/or filter module 4 may be an amplifier for example (in particular a transmission amplifier but alternatively also a reception amplifier) with an output stage and a driver stage. If applicable, a circulator for decoupling purposes may be provided as well. These components are accommodated in an amplifier housing 4*a*. Reference is made in this regard to FIGS. 2A and 2B. In addition, the at least one electronic and/or filter module 4 preferably also comprises a filter housing 4*b*. A high-frequency filter, in particular such a high-frequency filter having a cavity design is arranged in the filter housing 4*b*. Both the filter housing 4*b* as well as the amplifier housing 4*a* comprise a housing body that is formed from side elements and a floor element. This housing body is closed by respective housing lids. A first housing lid closes the amplifier housing 4*a* whereas a second housing lid is used to close the filter housing 4*b*.

By means of a signal line (not shown), the filter housing 4*b* and the amplifier housing 4*a* are connected and/or coupled to each other to transmit signals. In particular, the output of the performance amplifier may be coupled in the amplifier housing 4*a* by means of the signal line to a first resonator, and within it, to in particular a first resonator inner conductor within the filter housing 4*b*. Such a coupling is preferably capacitive. It could, however, be performed in an inductive or galvanic manner as well. Further resonators are formed in the filter housing 10*b*, which are coupled to each other more or less strongly, which causes the desired filter curve.

The amplifier housing 4*a* and the filter housing 4*b* of the at least one electronic and/or filter module 4 consist of and comprise metal or metal alloy. The amplifier housing 4*a* and the filter housing 4*b* may be produced from a joint milled and/or cast part so that they cannot be separated from each other non-destructively. Preferably, the amplifier housing 4*a* and the filter housing 4*b* are formed from separately formed milled and/or cast parts which are firmly connected by means of a mechanical connection, in particular a screw connection.

The at least one electronic and/or filter module 4 orients itself with its housing shape on the shape for example of the stepped first or second lateral housing side 2*c*, 2*d* of the antenna housing 2. In the embodiment shown, the electronic and/or filter module 4 therefore has an L shape when viewed from above. This shape is realized in particular because the amplifier housing 4*a* is preferably oriented with its longer side vertical or, with one component, substantially vertical to the housing longitudinal axis 3, whereas the filter housing 4*b* is preferably oriented with its longer side parallel or, with one component, substantially parallel to the housing longitudinal axis 3. The filter housing 4*b* and the amplifier housing 4*a* are preferably positioned vertically to each other. In this state, the amplifier housing 4*a* and the filter housing 4*b* are screwed together and inserted into the antenna housing 2.

To establish contact, the electronic and/or filter module 4 comprises a first connection port 6*a* and a second connection port 6*b*. The first connection port 6*a* and the second connection port 6*b* of the at least one electronic and/or filter module 4 are arranged parallel to each other (FIGS. 2A and 2B).

The two connection ports 6*a*, 6*b* are, when viewing the connection ports 6*a*, 6*b* from above, arranged offset from each other. They are preferably laterally offset and consecutively offset from each other. The two connection ports 6*a*, 6*b* preferably consist of metal and are furthermore preferably made from one piece with the housing 4*a*, 4*b* of the electronic and/or filter module 4 or molded to said module. A module-side plug connector 7*a*, 7*b* may be arranged in each case within or on the connection ports 6*a*, 6*b* and/or attached to the connection ports 6*a*, 6*b*. Preferably, the module-side plug connectors 7*a*, 7*b* protrude into the connection port 6*a*, 6*b* only in part. This is the case for the plug connectors 7*a*, 7*b*, as shown in FIG. 2B. It could also be that the connection ports 6*a*, 6*b* represent the module-side plug connectors 7*a*, 7*b* at the same time. In this case, the plug connectors 7*a*, 7*b* may preferably be screwed into the housing of the electronic and/or filter module 4 by means of a thread.

FIG. 2A is a spatial view of the electronic and/or filter module 4, wherein the first module-side plug connector 7*a* is not shown.

The module-side plug connectors 7*a*, 7*b* are preferably at least substantially rotationally asymmetrical. The electronic and/or filter modules 4 may, indirectly or directly, be fastened to the antenna housing 2 by means of an additional fastening device 8. This additional fastening device 8 is preferably formed in one piece with the housing of the electronic and/or filter module 4 or molded to said module. The fastening device 8 preferably comprises a screw connection.

The exact operating mode of the first and second module-side plug connectors 7*a*, 7*b* of the electronic and/or filter module 4 will be described in further detail below.

To allow a technician to replace the electronic and/or filter modules 4 at a great height, a reliable plug connection between the module-side plug connectors 7*a*, 7*b* of the electronic and/or filter module 4 and the counterpieces on the antenna housing 2 has to be established as simply and safely as possible.

To achieve this, the mobile-communications antenna 1 comprises at least one retaining and/or fastening frame 10. A spatial view of such a retaining and/or fastening frame 10 is shown for example in FIG. 3A to 3C. The retaining and/or fastening frame 10 comprises a frame carrier 11 which is fastened or can be fastened at least indirectly to the mobile-communications antenna 1 or to the antenna housing 2. Such a fastening may be achieved for example by means of screw connections. The fastening of the frame carrier 11 takes place during the mounting of the mobile-communications antenna 1. The electronic and/or filter module 4 can only be fastened to the frame carrier 11 (e.g., screw connection) by means of which it is then fastened indirectly to the mobile-communications antenna 1. It may also be fastened directly to the mobile-communications antenna 1.

The retaining and fastening frame 10 furthermore comprises at least one movable plug connector receiving sleeve 12, which comprises a housing wall 14 encircling a longitudinal axis 13 of the movable plug connector receiving sleeve 12 and comprises two end sides 12*a*, 12*b* located opposite each other. The first end side 12*a* comprises a sleeve insertion opening whereas the opposing second end side 12*b* is referred to as the sleeve bottom side. The encircling housing wall 14 surrounds and/or delimits an accommodating space 15, in which an antenna-side plug connector 9*a* is or can be arranged. The sleeve insertion opening is used here to receive the connection port 6*a*, 6*b* and/or the module-side plug connector 7*a*, 7*b* of the electronic and/or filter module 4.

The movable plug connector receiving sleeve 12 is fastened to the frame carrier 11 by means of a play compensation device 16 so that play between the frame carrier 11 and the movable plug connector receiving sleeve 12 is possible. The play compensation device 16 is arranged and/or formed in such a way that the play allows for a relative movement of the movable plug connector receiving sleeve 12 in relation to the frame carrier 10, the movement vector of the relative movement permitted by the play running transversely to a (starting) longitudinal axis 13 or centering axis of the movable plug connector receiving sleeve 12, in which the longitudinal or central axis of the plug connector receiving sleeve 12 which runs through the middle of the plug connector receiving sleeve 12 is generally found in its starting position. This movement vector preferably runs transversely to the reflector plane. Consequently, movement in different directions including in the peripheral direction around a central location is possible.

This makes it possible that the movable plug connector receiving sleeve 12 can be moved relative to its position to the frame carrier 11. Tolerances caused during the manufacture of the electronic and/or filter module 4 (in particular regarding the connection port 6*a*, 6*b*) do not make it difficult for a technician to replace a defective electronic and/or filter module 4 with a new electronic and/or filter module 4 at a great height. The technician can easily create a plug connection between the new electronic and/or filter module 4 and the corresponding plugs in the mobile-communications antenna 1.

The play allows for a movement of the movable plug connector receiving sleeve 12 relative to the frame carrier 11, wherein the movement vector of the relative movement is preferably only vertical to the longitudinal axis 13, the movement occurring across a length that is smaller than 2 cm or 1.5 cm or 1 cm or 0.8 cm or 0.6 cm or 0.4 cm or 0.2 cm or 0.1 cm, but greater than 0.05 cm or 0.1 cm or 0.2 cm or 0.3 cm or 0.5 cm or 0.7 cm. The movement occurs preferably in a plane that runs vertically to the longitudinal axis 13.

In the following some advantages are emphasized separately.

An advantage exists if the retaining and/or fastening frame 10 comprises the following feature:

- the fastening device 61 comprises n fastening clips 61*a*, 61*b* with $n \geq 2$, wherein the n fastening clips 61*a*, 61*b* are offset against each other with an angle $\alpha$, which preferably corresponds to $\alpha = 360°/n$.

A further advantage exists if the retaining and/or fastening frame 10 comprises the following feature:

- the fastening clips 61*a*, 61*b* are arranged closer to the first end side 12*a* of the movable plug connector receiving sleeve 12 than to the second end side 12*b*.

A further advantage exists if the retaining and/or fastening frame 10 comprises the following feature:

- at least one first resilient compression means 65 is arranged between the first fastening clip 61*a* and the first retaining clip 63*a* and at least one second resilient compression means 65 is arranged between the second fastening clip 61*b* and the second retaining clip 63*b*, wherein the compression means 65 can be compressed along its extension parallel or, with one component, substantially parallel to the longitudinal axis 13, wherein the movable plug connector receiving sleeve 12 is movable along the longitudinal axis 13.

A further advantage exists if the retaining and/or fastening frame 10 comprises the following features:

the length compensation means 30 is resilient the length compensation means 30 lies, when relaxed, against an inner wall (14*a*) of the movable plug connector receiving sleeve 12 at the most with a part of its peripheral surface.

A further advantage exists if the retaining and/or fastening frame 10 comprises the following features:

the length compensation means 30 is fully penetrated by a recess 32, wherein this recess 32 runs along or parallel to or, with one component, substantially parallel to the longitudinal axis 13;

in this recess 32 a) the antenna-side plug connector 9*a* and/or a connection cable of the antenna-side plug connector 9*a* are or can be inserted; or b) the module-side plug connector 7*a* and/or a connection cable of the module-side plug connector 7*a* are or can be inserted.

A further advantage exists if the retaining and/or fastening frame 10 comprises the following features:

the front end side 30*a* of the length compensation means 30 is arranged closer to the insertion opening of the movable plug connector receiving sleeve 12 than to its back end side 30*b;* the recess 32 comprises at least at the access opening on the front end side 30*a* of the length compensation means 30 a first coded shape 40, wherein the antenna-side or module-side plug connector 9*a*, 7*a* has a corresponding shape across at least an insertion length so that the antenna-side or the module-side plug connector 9*a*, 7*a* is or can be inserted in the recess 32 of the length compensation means 30 in only a certain orientation or angular position.

A further advantage exists if the retaining and/or fastening frame 10 comprises the following features:

the second end side 12*b* of the movable plug connector receiving sleeve 12 is opened only in part, wherein the opening comprises a second coded shape, wherein the back end side 30*b* of the length compensation means 30 comprises a protrusion 41 through which the recess 32 exits;

the protrusion 41 of the length compensation means 30 comprises a shape which corresponds to the second coded shape of the opening so that the length compensation means 30 is or can be inserted into the opening of the second end side 12*b* of the movable plug connector receiving sleeve 12 only in a certain orientation or angular position.

In principle, it is also possible that the play permits an inclination of the movable plug connector receiving sleeve 12 relative to the frame carrier 11 and/or a rotation of the movable plug connector receiving sleeve 12 relative to the frame carrier 11, the movable plug connector receiving sleeve 12 being rotatable by less than 10° or 8° or 6° or 4° or 2° or 1°, but by more than 0.1° or 0.2° or 0.3° or 0.5° or 1.5° or 3° or 5° or by more than 7° relative to the frame carrier 11.

Finally, it is also possible that the play permits a movement and position change of the plug connector receiving sleeve 12 on circular paths relative to the frame carrier 11, in particular around the (starting) longitudinal or centering axis 13 (longitudinal axis), i.e., the axis that the plug connector receiving sleeve 12 adopts in its usually unadjusted starting position. In other words, therefore, an adjustment of the plug connector receiving sleeve 12 on preferably one or more movement paths is possible, which movement paths are in a plane that is preferably vertical to the (starting) longitudinal or centering axis 13 or deviates from it at an angle that is preferably smaller than 20° or smaller than 10°, 8°, 6°, 4°, 2° or smaller than 1°.

Within the accommodating space 15 of the movable plug connector receiving sleeve 12, an antenna-side plug connector 9*a* is preferably arranged. This antenna-side plug connector 9*a* is preferably movably positioned in the accommodating space 15 along the longitudinal axis 13 and/or is displaceable. Preferably, this antenna-side plug connection 9*a* is positioned in a resilient manner.

Figure 3A:
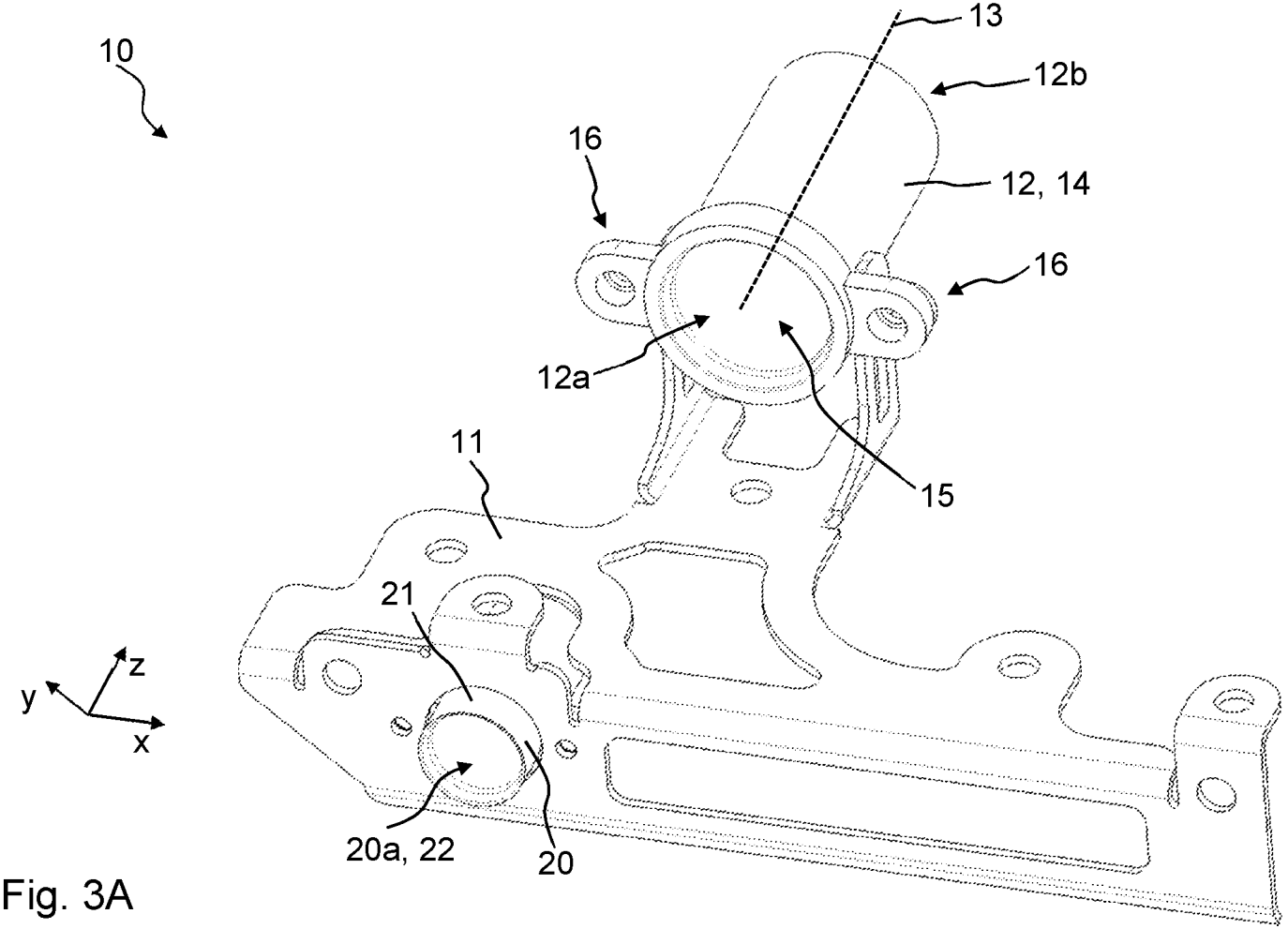
Figure 3B:
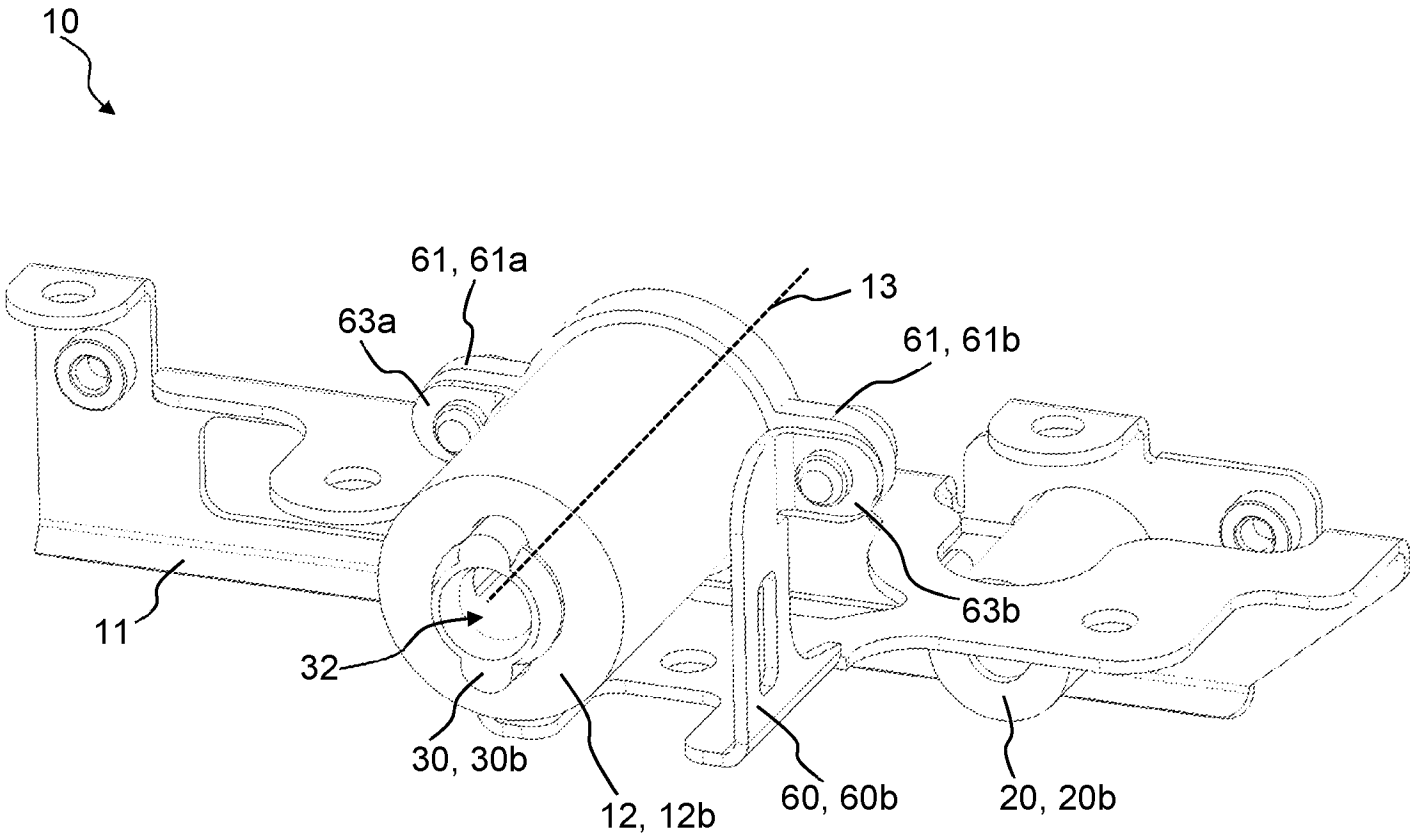
Figure 3C:
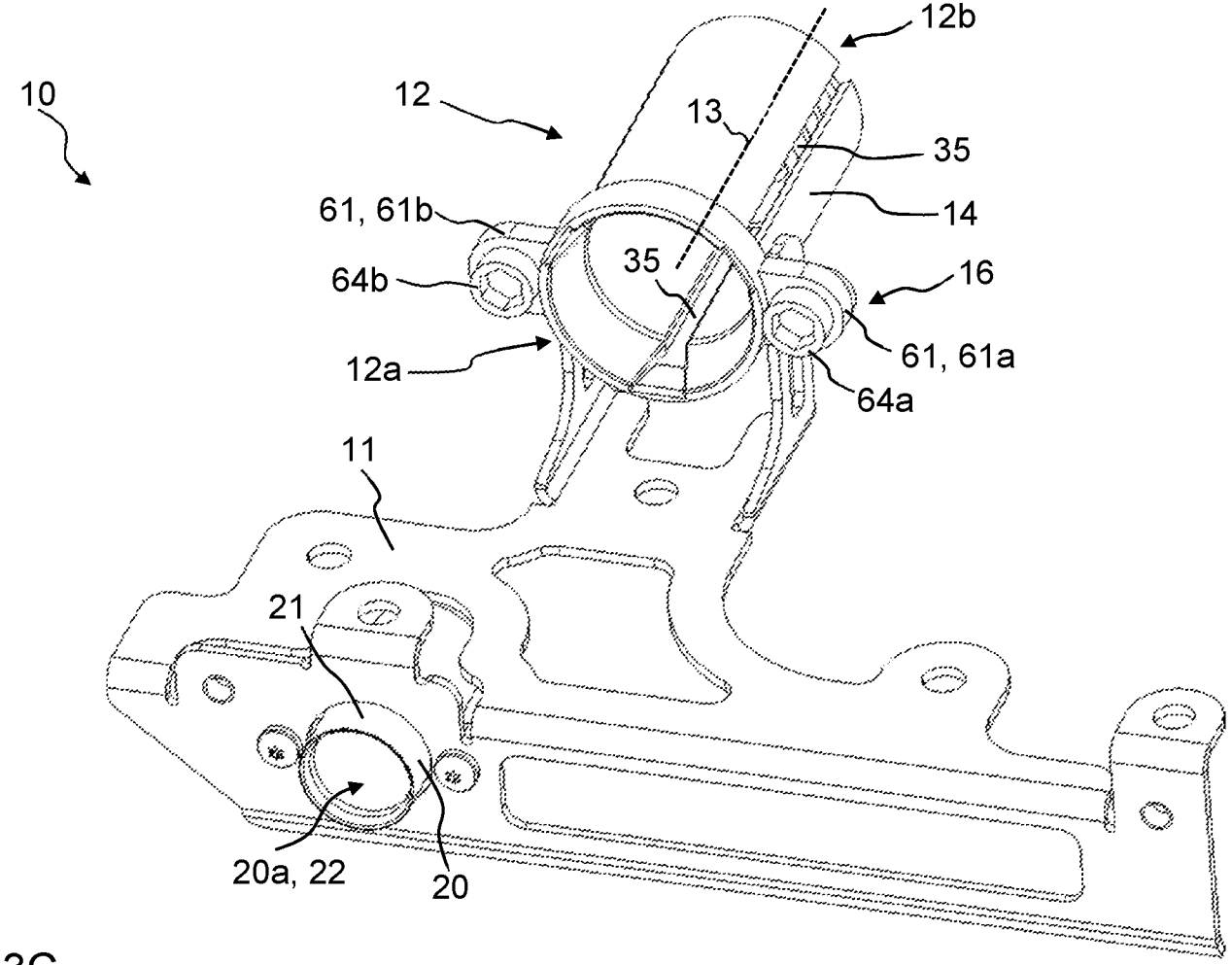

In contrast to the movable plug connector receiving sleeve 12, FIG. 3A to 3C also show an immovable plug connector receiving sleeve 20. The immovable plug connector receiving sleeve 20 is firmly, and therefore without play, connected to the frame carrier 11. The immovable plug connector receiving sleeve 20 also comprises two opposing end sides 20*a*, 20*b*, the first end side 20*a* being the sleeve insertion opening and the opposing second end side 20*b* being the sleeve bottom side of the immovable plug connector receiving sleeve 20. An encircling housing wall 21 of the immovable plug connector receiving sleeve 20 surrounds an accommodating space 22, in which a further antenna-side plug connector 9*b* is or can be arranged. The sleeve insertion opening of the immovable plug connector receiving sleeve 20 serves to accommodate the further connection port 6*b* and/or the further module-side plug connector 7*b* of the electronic and/or filter mode 4.

The immovable plug connector receiving sleeve 20 and the at least one movable plug connector receiving sleeve 12, when looking at the insertion opening from above, are either laterally offset from each other or laterally and consecutively offset from each other. Their position corresponds here to the position of the connection ports 6*a*, 6*b* of the electronic and/or filter mode 4 to be inserted.

What is not shown is that the retaining and/or fastening frame 10 comprises at least one more movable plug connector receiving sleeve 12. In principle, all plug connector receiving sleeves 12 can be movable. Preferably, only one plug connector receiving sleeve 20 is immovable. In this case, the movable plug connector receiving sleeves 12 would, when looking at the insertion openings from above, either be laterally offset from each other or laterally and consecutively offset from each other.

FIG. 4 is a rear view of the retaining and/or fastening frame 10 according to the invention. It shows the second end side 12*b*, i.e., the sleeve bottom side, of the movable plug connector receiving sleeve 12 and the second end side 20*b*, i.e., the sleeve bottom side, of the immovable plug connector receiving sleeve 20. FIG. 4 also shows the lateral offset of the movable plug connector receiving sleeve 12 and the immovable plug connector receiving sleeve 20.

FIG. 5 shows a longitudinal section along the longitudinal axis 13 through the retaining and/or fastening frame 10 according to the invention. The movable plug connector receiving sleeve 12 comprises at least one portion 25 that extends in the direction of the longitudinal axis 13 to the first end side 12*a*, in which the diameter of the movable plug connector receiving sleeve 12 increases. In particular, the interior diameter increases here. In this way, it becomes easier to insert the corresponding connection port 6*a*, 6*b* and/or the module-side plug connector 7*a*, 7*b* of the electronic and/or filter module 4 into the accommodating space 15.

Figure 10A:
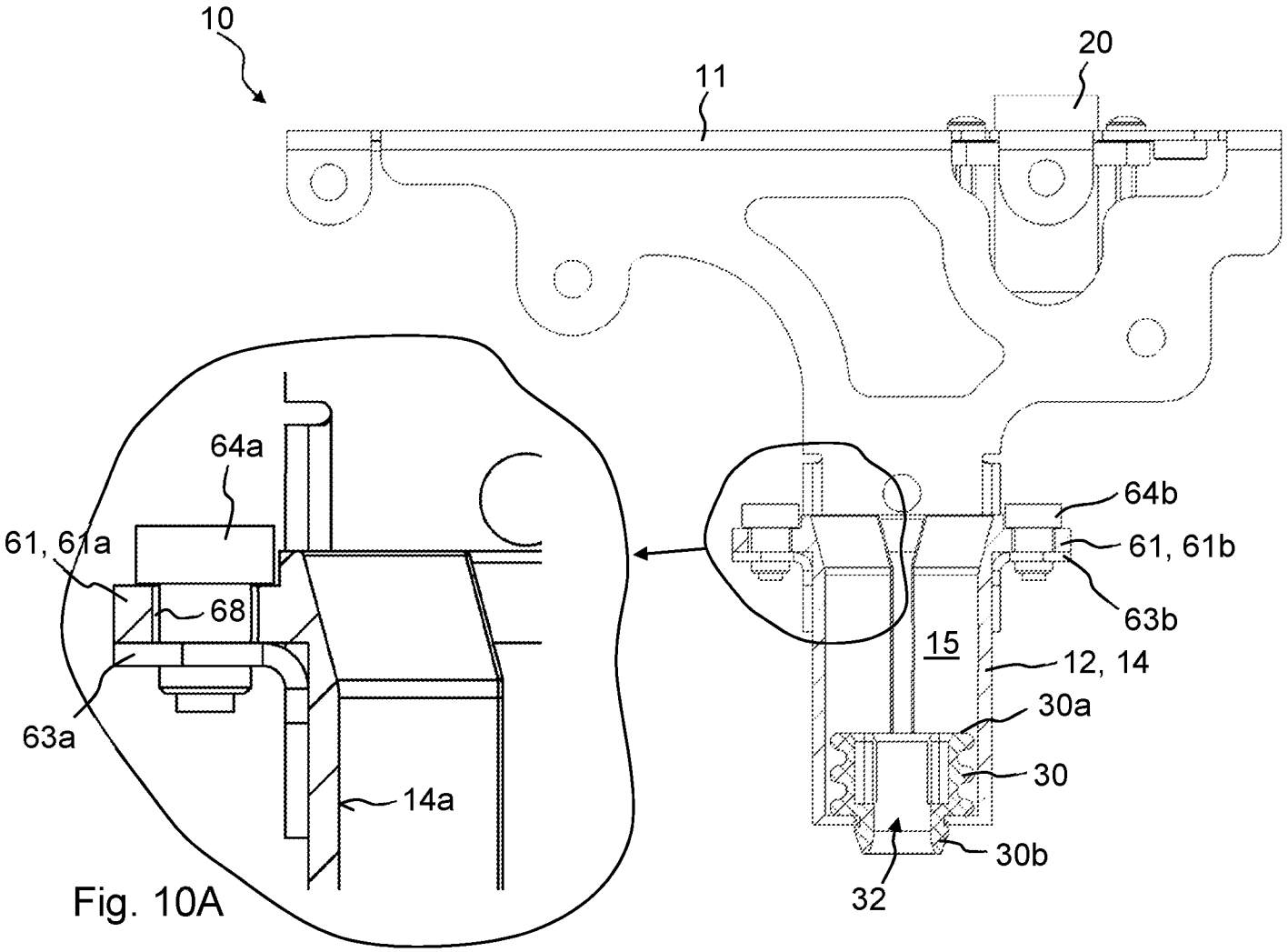

The retaining and/or fastening frame 10 according to the invention comprises at least one length compensation means 30 that comprises a front end side 30*a* and a back end side 30*b*. The at least one length compensation means 30 is preferably arranged substantially within the accommodating space 15 of the movable plug connector receiving sleeve 12. It is therefore arranged closer to the second end side 12*b* of the movable plug connector receiving sleeve 12 than to the first end side 12*a*. Preferably, the second end side 12*b* of the movable plug connector receiving sleeve 12 is not opened across the entire inner diameter of the encircling housing wall 14 so that a support shoulder 31 is still formed on which the at least one length compensation means 30 can rest. The at least one length compensation means 30 can comprise a snap mechanism on its back end side 30*b* that snaps into the support shoulder 31. Then the length compensation means 30 would be axially immovably arranged in the accommodating space 15. Such a snap mechanism is shown for example in FIG. 10A.

The at least one length compensation means 30 is generally formed so that antenna-side plug connectors 9*a* that are or can be arranged in the accommodating space 15 are movable along the longitudinal axis 13 in the direction of the second end side 12*b* or away from the second end side 12*d* in the direction of the first end side 12*a*.

The at least one length compensation means 30 is preferably formed in a resilient and/or springy manner. The length compensation means 30 lies, in the relaxed state, against an inner wall 14*a* of the movable plug connector receiving sleeve 12 at the most with a part of its peripheral surface. The length compensation means 30 may have, for example, the form of bellows and consist of or comprise preferably plastics material or rubber or rubber-like material. In the relaxed state, it has the greatest extension along the longitudinal axis 13. It may, however, be compressed as well so that its extension along the longitudinal axis 13 decreases. This happens when the antenna-side plug connector 9*a* is pushed further in the direction of the second end side 12*b*. This is the case when the connection port 6*a*, 6*b* and/or the module-side plug connector 7*a*, 7*b* of the electronic and/or filter module 4 are inserted. This means that the antenna-side plug connector 9*a* is movable relative to the frame carrier 11 both in a plane that is vertical or, with one component, substantially vertical to the longitudinal axis 13 and along the longitudinal axis 13. The antenna-side plug connector 9*a* is therefore movable with three translatory degrees of freedom (X-, Y- and Z-direction) relative to the frame carrier 11.

The length compensation means 30 is preferably completely penetrated by a recess 32, this recess 32 running along the longitudinal axis 13 and/or substantially parallel to the longitudinal axis 13. The antenna-side plug connector 9*a* and/or a connection cable of the antenna-side plug connector 9*a* is or can be inserted into this recess 32. Preferably, the recess 32 comprises a changing cross-sectional shape along its extension. It may, for example, have the shape of a funnel to be able to better accommodate the antenna-side plug connector 9*a*.

Figure 6B:
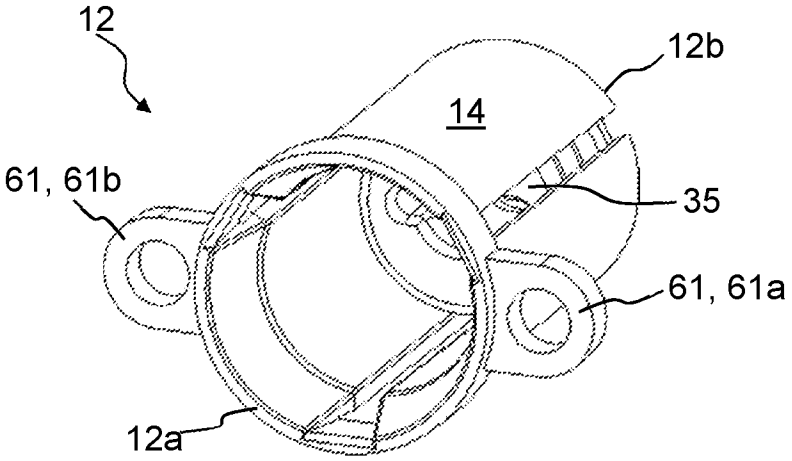
Figure 6C:
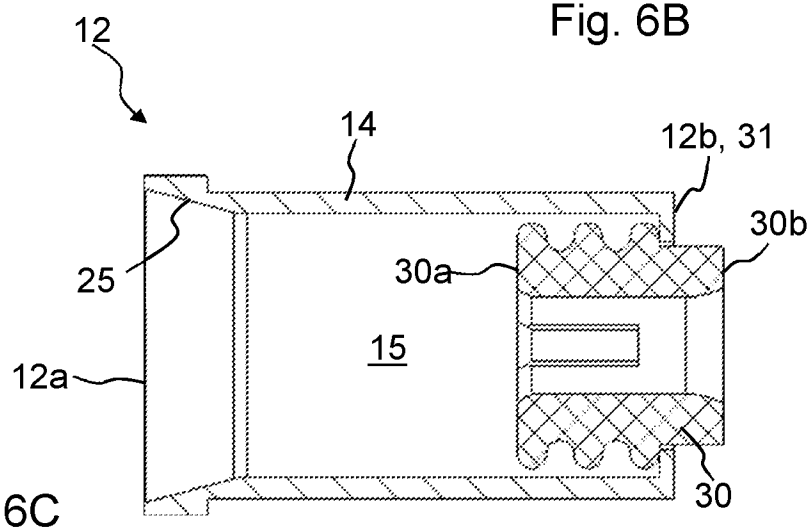
Figure 6A:
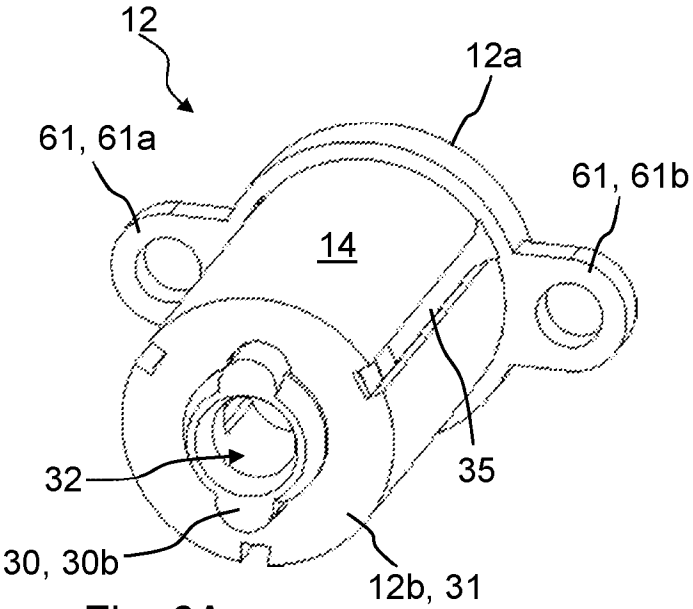

FIG. 6A to 6C are spatial views of another embodiment of the movable plug connector receiving sleeve 12. The movable plug connector receiving sleeve 12 comprises at least one or at least two or at least three receiving slots 35 which extend across part of the length or across the entire length of the movable plug connector receiving sleeve 12 and that run parallel or, with one component, substantially parallel to the longitudinal axis 13. The receiving slots 35 are formed to guide the connection port 6*a*, 6*b* of the electronic and/or filter module 4 and/or the module-side plug connector 7*a*, 7*b* of the electronic and/or filter module 4, protrusions being provided on the connection ports 6*a*, 6*b* and/or the module-side plug connectors 7*a*, 7*b* of the electronic and/or filter module 4. These protrusions then engage with the receiving slots 35.

Preferably, the encircling housing wall 14 of the movable plug connector receiving sleeve 12 provides by means of the receiving slots 35 an opening that extends at least across part of the length along the longitudinal axis 13 of the encircling housing wall 14 and which is accessible from outside the movable plug connector receiving sleeve 12.

Preferably, the encircling housing wall 14 is closed in the region of the first end side 12*a* of the movable plug connector receiving sleeve 12. In the region of the second end side 12*b*, in particular in the floor region of the second end side 12*b* of the movable plug connector receiving sleeve 12, it is preferably substantially closed as well.

These receiving slots 35 are offset against each other in the circumferential direction of the encircling housing wall 14. They are, in particular, offset from each other at an equal distance.

The receiving slots 35 extend to the first end side 12*a* of the movable plug connector receiving sleeve 12 and are accessible from the insertion opening (but not necessarily from the outside through the encircling housing wall 14) and end at a distance from the second end side 2*b* or run to the second end side 2*b*. The receiving slots 35 widen preferably toward the first end side 12*a* and therefore act as a centering aid and/or insertion funnel.

Figure 8B:
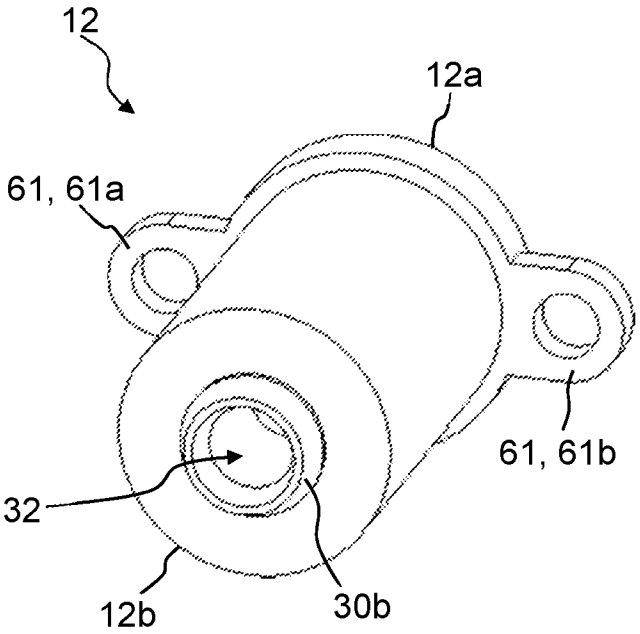
Figure 8A:
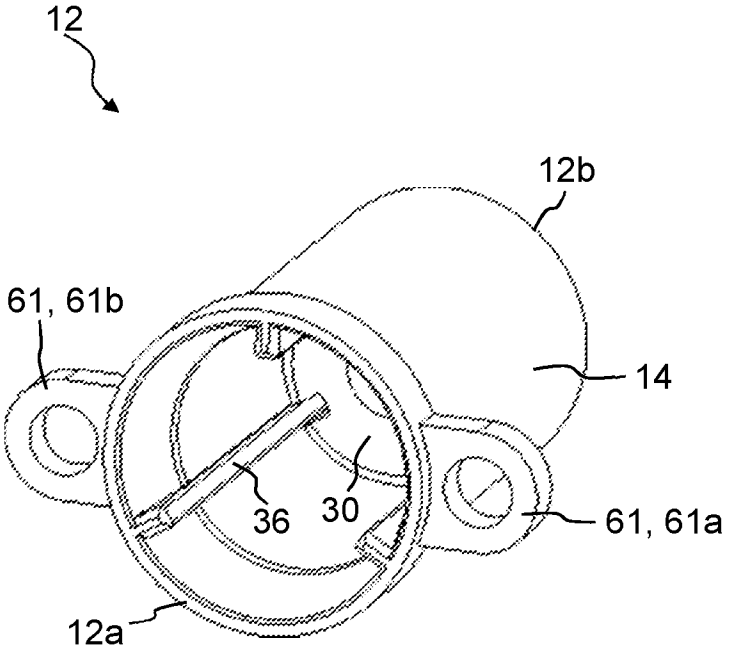

FIGS. 8A and 8B show a further embodiment of the movable plug connector receiving sleeve 12. Instead of receiving slots 35, the movable plug connector receiving sleeve 12 comprises guiding ridges 36 that are arranged on the inner wall 14*a* of the encircling housing wall 14 and that preferably protrude radially into the accommodating space 15. There are preferably at least one or at least two or at least three guiding ridges 36 which extend at least across part of the length or across the entire length of the movable plug connector receiving sleeve 12 and that run parallel or, with one component, substantially parallel to the longitudinal axis 13. The guiding ridges 36 are also formed to guide the connection port 6*a*, 6*b* of the electronic and/or filter module 4 and/or the module-side plug connector 7*a*, 7*b* of the electronic and/or filter module 4, grooves being formed on a peripheral wall of the connection port 6*a*, 6*b* and/or a circumferential wall of the module-side plug connector 7*a*, 7*b* of the electronic and/or filter module 4 with which these guiding ridges 36 engage.

The guiding ridges 36 extend preferably to the first end side 12*a* of the movable plug connector receiving sleeve 12 and are accessible from the insertion opening and end at a distance from the second end side 12*b* and/or run to the second end side 12*b*. The guiding ridges 36 may be perforated in one or more places. The guiding ridges 36 taper preferably in the direction of the first end side 12*a*. Regarding the height with which they protrude into the accommodating space 15, they may also shorten in the direction of the first end side 12*a*. The guiding ridges 36 may be at an equal distance from each other. In this case, a symmetrical arrangement would be present. They could, however, also be located at different distances from each other so that the module-side plug connector 7*a*, 7*b* or the connection port 6*a*, 6*b* of the electronic and/or filter module 4 can only be inserted into the accommodating space 15 at a specific rotation or angular position.

Figure 7B:
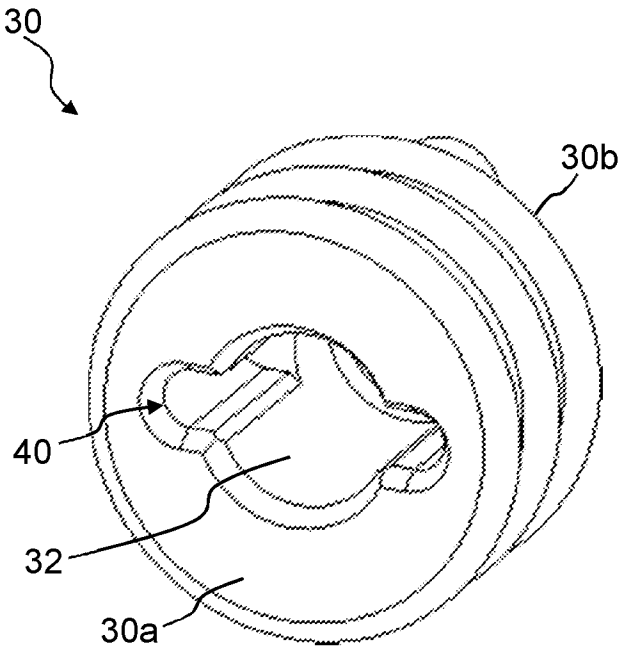
Figure 7A:
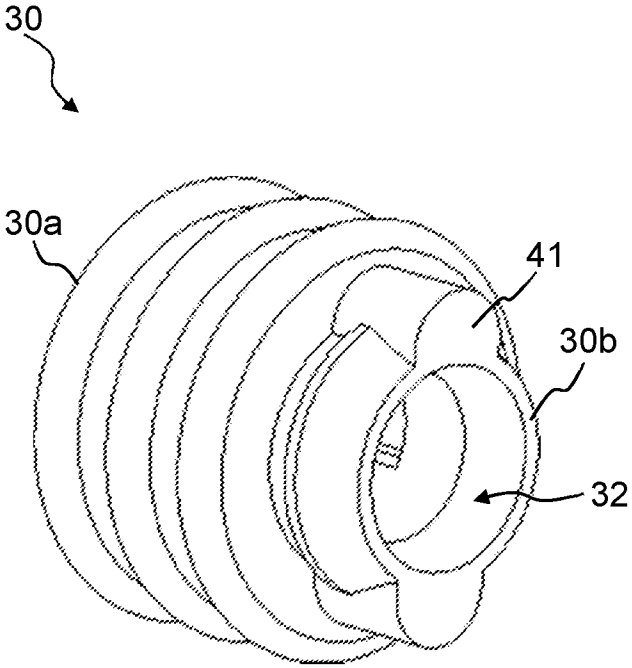

FIGS. 7A and 7B are spatial views of an embodiment of the length compensation element 30. The length compensation element 30 comprises an alternating diameter along its length. FIG. 7A is a view of the back end side 30*b*, whereas FIG. 7B is a view of the front end side 30A. The recess 32 that penetrates the length compensation means 30 comprises at the exit from the front end side 30*a* a first coded shape 40, wherein the antenna-side plug connector 9*a* that can be inserted across at least an insertion length at which it can be inserted into the recess 32 has a corresponding shape so that the antenna-side plug connector 9*a* is or can be inserted in the recess 32 of the length compensation means 30 only at a certain orientation or angular position.

The second end side 12*b* of the movable plug connector receiving sleeve 12 is opened only in part, wherein the opening has a second coded shape, the back end side 30*b* of the length compensation means 30 preferably comprising a protrusion 41 which has a shape that corresponds to the second coded shape of the opening. This way, the length compensation means 30 can be inserted into the opening of the second end side 12*b* of the movable plug connector receiving sleeve 12 only in a certain orientation or angular position. These circumstances are shown in FIG. 6A.

The first coded shape 40 and the second coded shape may be the same or different. Preferably, the second shape is chosen so that the length compensation means 30 can be inserted at only one angular position and/or orientation. The same applies as well for the antenna-side plug connector 9*a*, which can preferably only be inserted into the recess 32 of the length compensation means 30 across an insertion length at only one angular position and/or orientation.

Figure 11A:
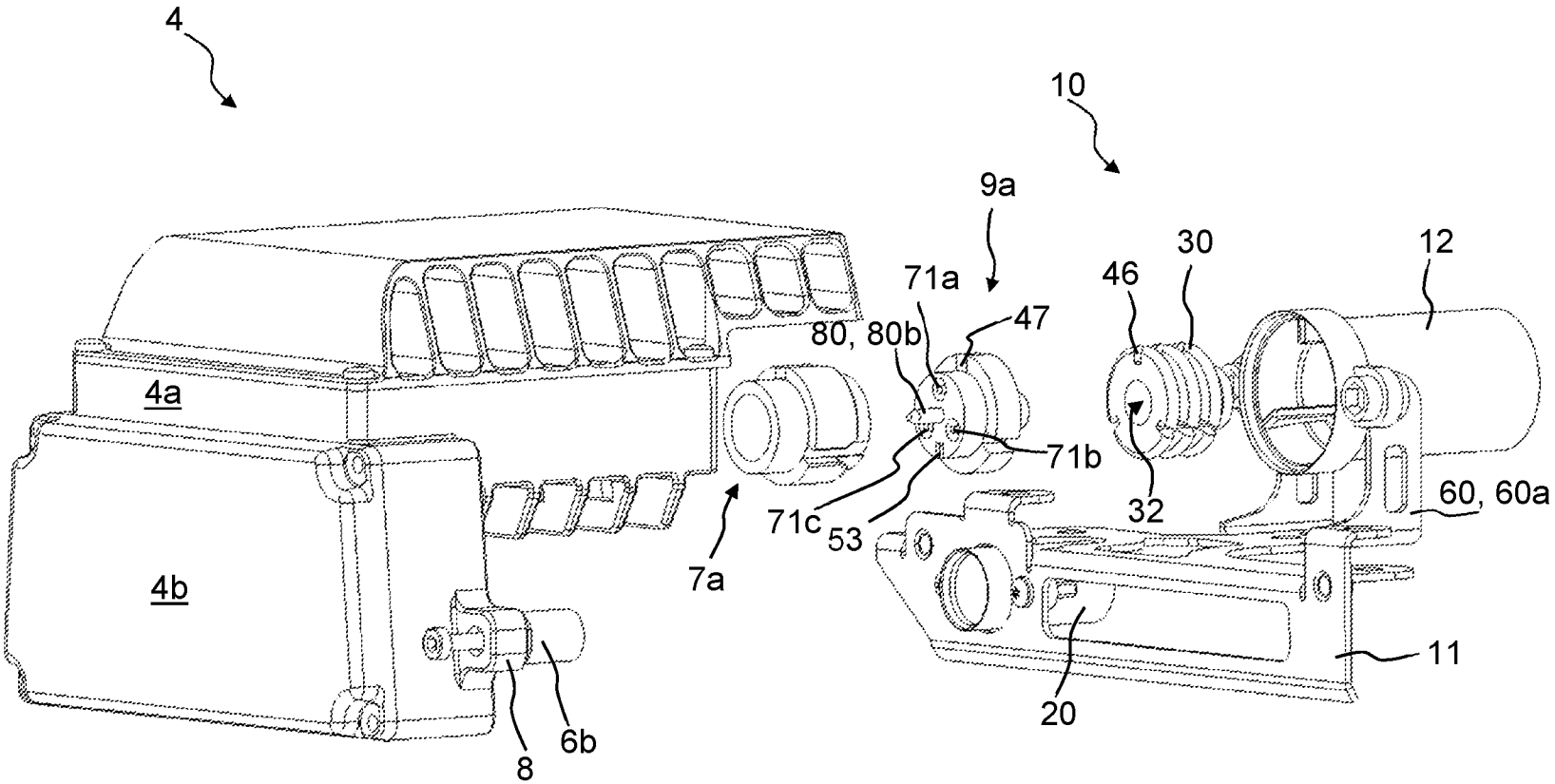
Figure 11B:
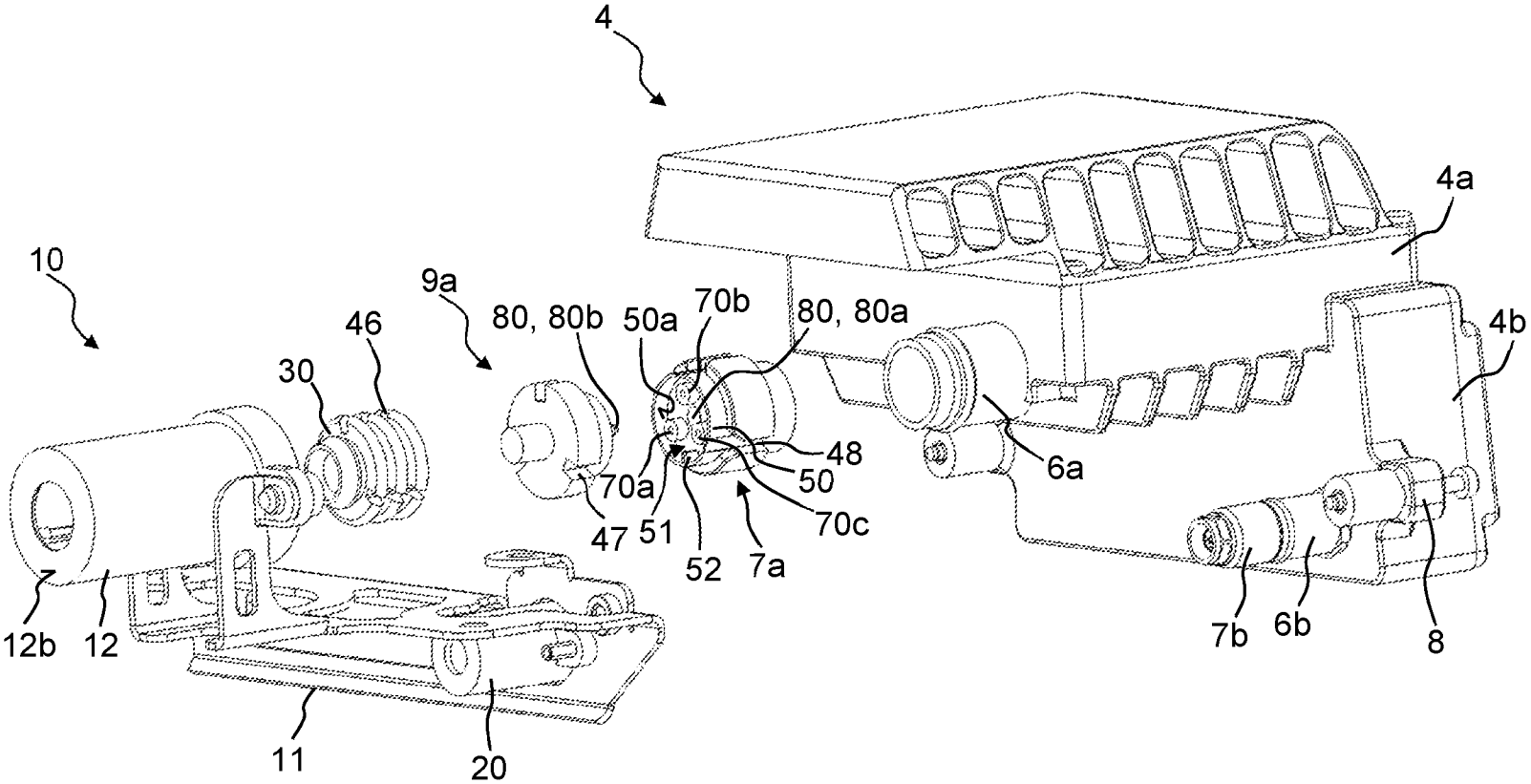
Figure 12A:
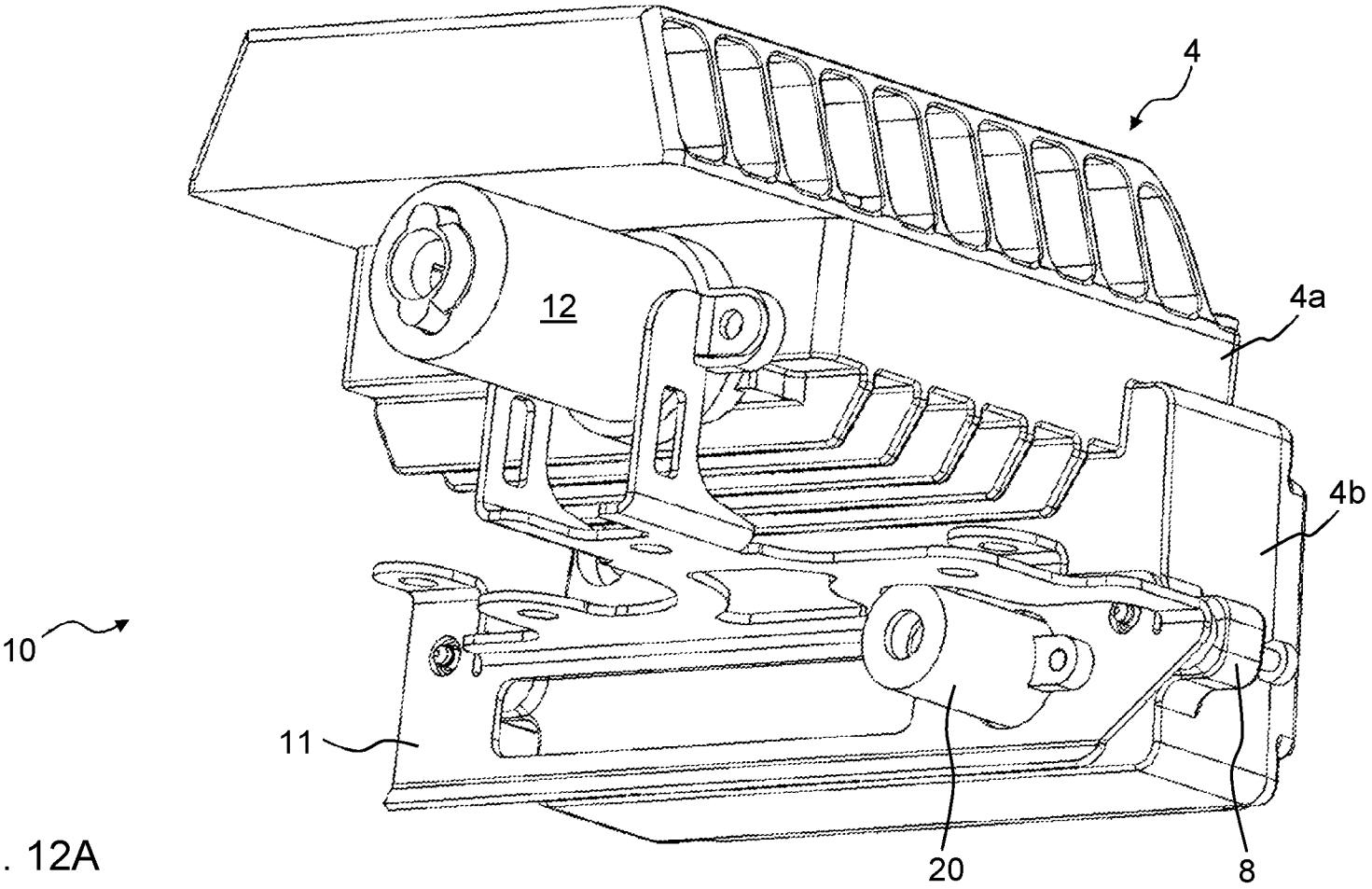
Figure 12B:
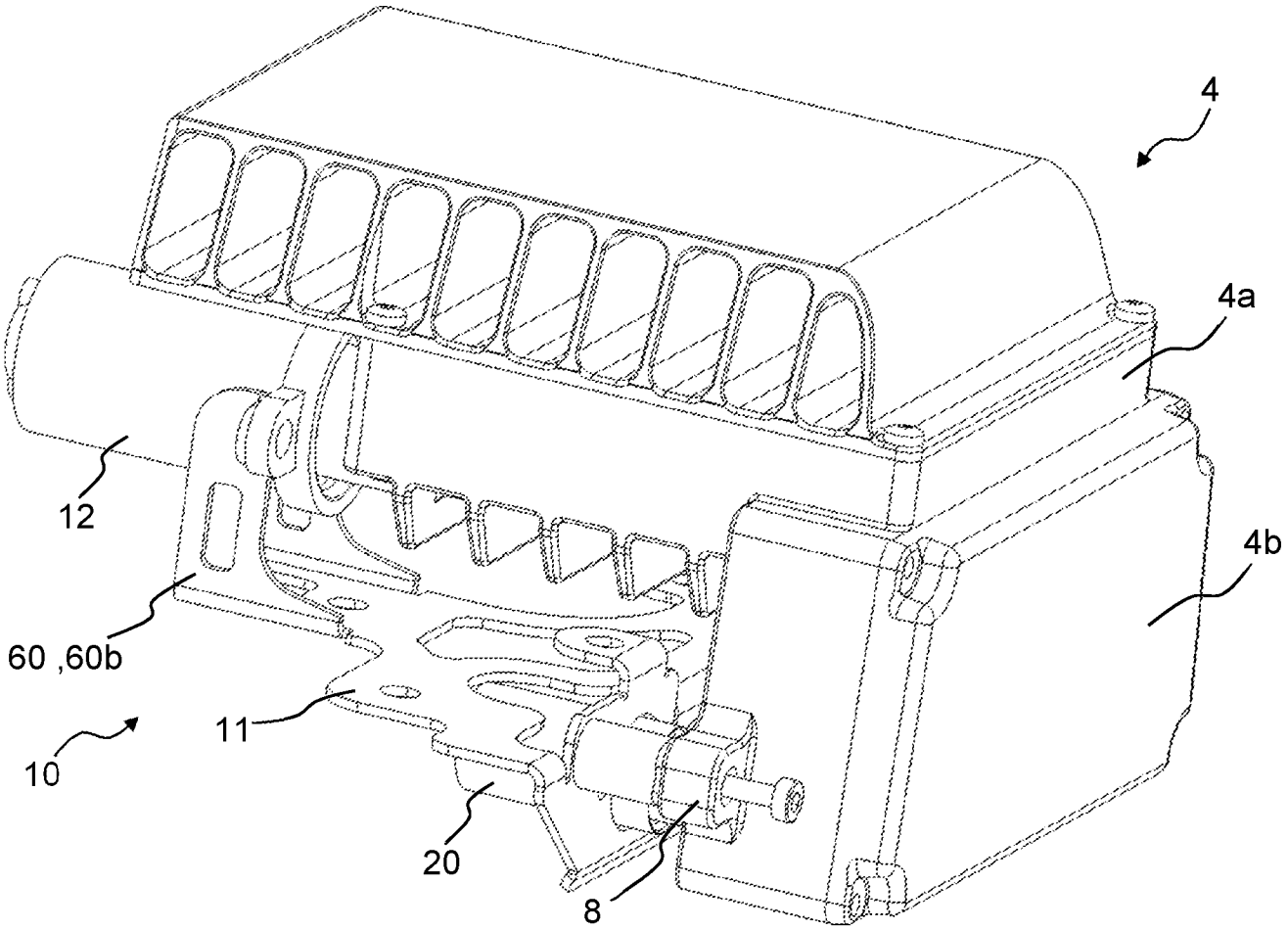

In principle, the length compensation means 30 may also comprise a groove 46 along the longitudinal axis, the dimensions of the groove 46 being such that the guiding ridge 36 of the movable plug connector receiving sleeve 12 according to FIGS. 8A and 8B engages therewith. This could then also ensure that the length compensation means can only be inserted in the accommodating space 15 at a certain orientation and/or angular position. In that case, a coded shape is not necessary. Such an example is shown in FIGS. 11A and 11B.

In this case, it would be also advantageous if the antenna-side plug connector 9*a* were to comprise a groove 47 along the longitudinal axis as well. This would ensure that said plug connector could be inserted in the accommodating space 15 only at a certain orientation and/or angular position as well.

Preferably, a slot is also formed between the antenna-side plug connector 9*a* and an inner wall 14*a* of the encircling housing wall 14. The connection port 6*a*, 6*b* of the electronic and/or filter module 4 may engage in this slot. A push-in sleeve 50, which protrudes laterally from the plug connector 7*a*, 9*a* formed as a plug might engage in this slot as well (at its peripheral wall) and delimit a contact space 51. Such a push-in sleeve 50 is shown for example in FIG. 11B.

The play compensation device 16 is described with reference to FIGS. 3B, 3C 9, 10A, and 10B. The play compensation device 16 comprises a suspension device 60 and a fastening device 61. The suspension device 60 is preferably attached to the frame carrier 11 as one piece or molded thereon. The fastening device 61 is arranged on the encircling housing wall 14 of the movable plug connector receiving sleeve 12 or molded thereon. The fastening device 61 is preferably formed as one piece with the movable plug connector receiving sleeve 12.

The suspension device 60 comprises at least two retaining portions 60*a*, 60*b* which are at a distance from each other, creating a space 62 between them. The movable plug connector receiving sleeve 12 is arranged in this space 62. The fastening device 61 comprises at least two fastening clips 61*a*, 61*b* each fastening clip 61*a*, 61*b* comprising an opening having a first diameter. The retaining portions 60*a*, 60*b* each comprise a retaining clip 63*a*, 63*b*, the retaining clips 63*a*, 63*b* also comprising an opening having a second diameter. A first connecting means, in particular in the form of a first screw connection 64*a*, penetrates the opening of the first fastening clip 61*a* and the opening of the first retaining clip 63*a*, and a second connecting means 64*b*, in particular in the form of a second screw connection 64*b*, penetrates the opening of the second fastening clip 61*b* and the opening of the second retaining clip 63*b*. A diameter of the respective connecting means 64*a*, 64*b*, in particular in the form of a screw body, is smaller than the first diameter of the fastening clips 61*a*, 61, which forms a slot 68 and wherein the fastening clips 61*a*, 61*b* are positioned on the respective retaining clip 63*a*, 63*b* with some play. The connecting means 64*a*, 64*b* is preferably connected with a force fit to the respective retaining clip 63*a*, 63*b*.

In the case that the center of the opening of the first or second fastening clip 61*a*, 61*b* is congruently arranged above the center of the opening of the first or second retaining clip 63*a*, 63*b*, the movable plug connector receiving sleeve 12 is in the starting position. From this starting position, the movable plug connector receiving sleeve 12 may be moved and/or displaced relative to the frame carrier 11. The movement takes place in a plane (X-Y plane), the plane running and/or being arranged transversely, in particular vertically, or, with one component, substantially vertically to the reflector plane.

The screw head preferably has a larger diameter than the first diameter of the fastening clips 61, 61*b* so that said screw head rests on the fastening clips 61*a*, 61*b*. By means of a nut that rests against the retaining clips 63, 63*b* and that is penetrated by the screw body, the movable plug connector receiving sleeve 12 is kept movable on the suspension device 60 of the frame carrier 11 by means of its fastening device 61. Preferably, a play is only allowed in a plane that is vertical to the longitudinal axis 13. In principle, the connecting means 64 might also be a rivet joint.

The fastening device 61 preferably comprises n-fastening clips 61*a*, 61*b* which more preferably are offset from each other at an angle $\alpha$. Preferably, the angle $\alpha=360°/n$. The fastening clips 61*a*, 61*b*, which can very clearly be seen in FIG. 3A as well, are arranged closer to the first end side 12*a* of the movable plug connector receiving sleeve 12 than to the second end side 12*b*. They may, however, be arranged closer to the second end side 12*b* than to the first end side 12*a*. They could also be generally arranged in the middle between the first and the second end side 12*a*, 12*b*.

FIG. 3B is a spatial rear view of the retaining and/or fastening frame 10 according to the invention. In this rear view, the nut of the screw connection 64*a*, 64*b* is shown that rests against a back end side of the retaining clips 63*a*, 63*b*.

Figure 10B:
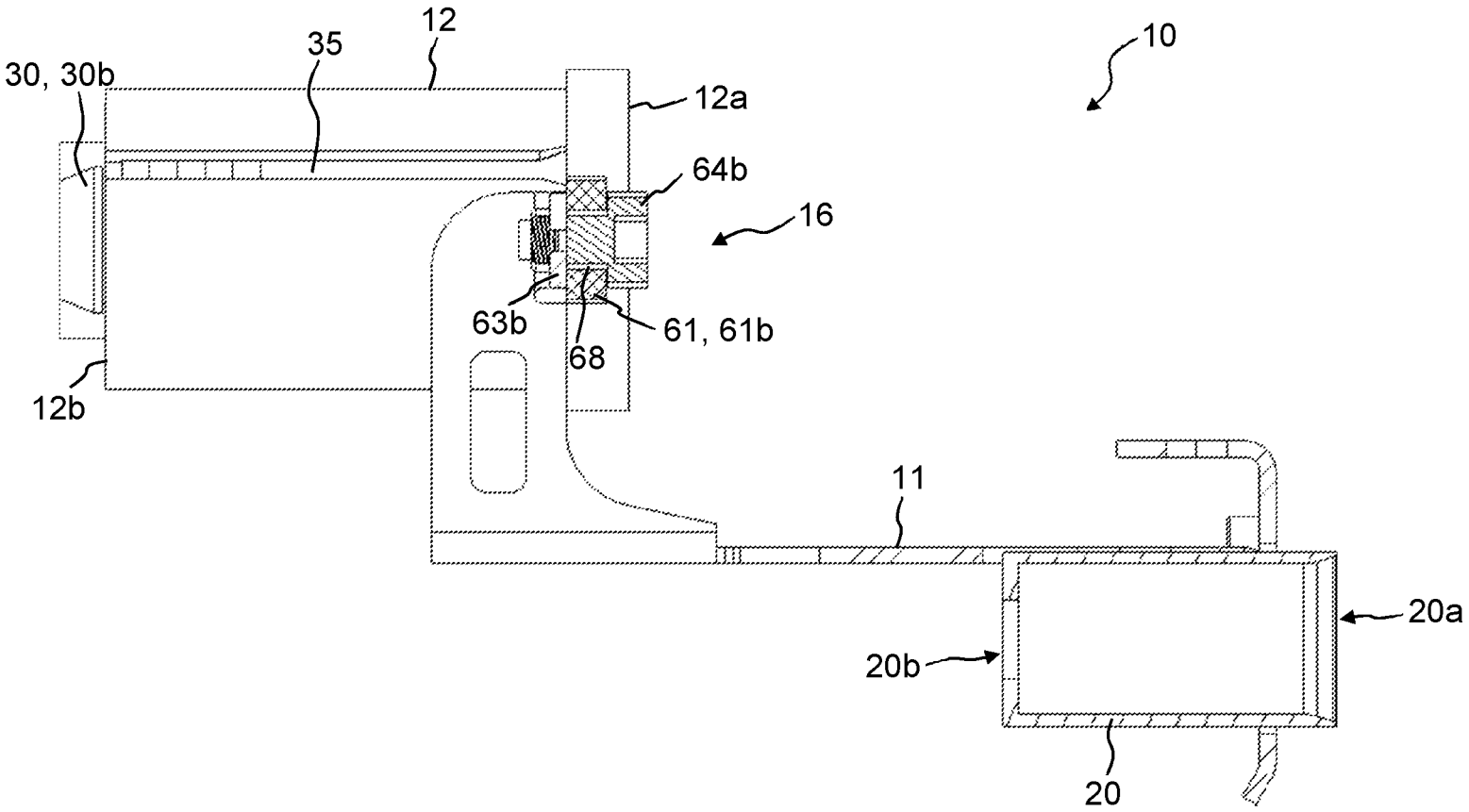

FIG. 10B shows a section through the retaining and/or fastening frame 10 according to the invention, the section showing in particular the play compensation device 16. The slot 68 between the screw connection 64*b* and the corresponding fastening clip 61*b* is easy to see. The respective retaining clip 63*b*, whose back end side is once again covered by a nut, directly adjoins the fastening clip 61*b*.

When using a screw connection 64*b*, the screw head could also rest against the respective retaining clip 63*b* whereas the nut rests against the respective fastening clip 61*b*.

FIG. 9 also shows that a first and/or second compression means 65 is attached between the fastening clips 61, 61*b* and the retaining clips 63*a*, 63*b* either in addition or alternatively to the length compensation means 30. This first and/or second resilient compression means 65 may also consist of the same materials as the length compensation means 30. In the simplest case, it could be a tongue. This resilient compression means 65 may be pushed together, which means the movable plug connector receiving sleeve 12 would be movable along the longitudinal axis 13.

FIGS. 11A and 11B are exploded views of the retaining and/or fastening frame 10 and of the electronic and/or filter module 4, whereby the interaction of these two components is described in further detail.

The length compensation element 30, just as the antenna-side plug connector 9*a*, comprises a groove 46, 47 at the corresponding outer peripheral wall. The guiding ridges 36, which are arranged on an inner wall 14*a* of the encircling housing wall 14 of the movable plug connector receiving sleeve 12, engage with these grooves 46, 47.

This results in a twist protection of the antenna-side plug connector 9*a* and of the length compensation element 30 relative to the movable plug connector receiving sleeve 12. This completely prevents any twisting; i.e., the capacity to twist is less than 2° or less than 1° or less than 0.5°.

Particular attention is paid to the plug connectors 7*a*, 9*a*. In addition to the antenna-side plug connector 9*a* as shown in FIG. 11A, there is also the module-side plug connector 7*a* of the electronic and/or filter module 4. The antenna-side plug connector 9*a* is formed in this case in the shape of a plug, the module-side plug connector 7*a* of the electronic and/or filter module 4 being formed as a female connector. The reverse may be the case as well, however. The plug connectors 7*a*, 9*a* comprise in this embodiment three connections 70*a*, 70*b*, 70*c* each. There could, however, be less or more than three connections 70*a*, 70*b*, 70*c*. These connections 70*a*, 70*b*, 70*c* are preferably arranged symmetrically. They may, however, be arranged asymmetrically as well. It would also be possible that there is only one connection 70*a*, 70*b*, 70*c*.

At least one or a plurality of the connections 70*a*, 70*b*, 70*c* may contain an electrical conductor through which an electrical contact between the two plug connectors 7*a*, 9*a* can be created. The electrical conductor may be formed by an inner conductor, which is preferably surrounded by an outer conductor. It would also be possible that a capacitive coupling to at least one connection 70*a*, 70*b*, 70*c* of another plug connector 7*a*, 9*a* is created by means of at least one of the connections 70*a*, 70*b*, 70*c* of a plug connector 7*a*, 9*a*. The creation of an optical connection would be conceivable as well. In this case, the respective connections 70*a*, 70*b*, 70*c* would act as optical interfaces.

In principle, connections 70*a*, 70*b*, 70*c* of the plug connectors 7*a*, 9*a* may all be of the same type or of different types. A first connection 70*a* of both plug connectors 7*a*, 9*a* may, for example, be a coaxial connection, whereas a second connection 70*b* of both plug connectors 7*a*, 9*a* comprises an optical interface, whereas a third connection 70*c* of both plug connectors 7*a*, 9*a* provides a capacitive coupling.

A centering device 80 is located at the center of the plug connector 7*a*, 9*a*. The centering device 80 comprises either a centering opening 80*a* or a centering pin 80*b*. As soon as a plug connection is to be created by the two plug connectors 7*a*, 9*a*, first the centering opening 80*a* comes in contact with the centering pin 80*b*. This way, the two plug connectors 7*a*, 9*a* are precisely adjusted so that the connections 70*a*, 70*b*, 70*c* are directly on top of each other, i.e., in a coaxial orientation to each other. Preferably, the centering pin 80*b* tapers at the end, which first engages with the centering opening 80*a*. In contrast, the diameter of the centering opening 80*a* preferably increases in the region of the insertion opening for the centering pin 80*b*.

In the embodiment of FIG. 11B, the antenna-side plug connector 9*a* comprises the centering pin 80*b* whereas the module-side plug connector 7*a* of the electronic and/or filter module 4 comprises the centering opening 80*a*. The reverse would work just as well.

The connections 70*a*, 70*b*, 70*c* may be an electrical connection. It may, however, be an optical connection as well.

What is also shown is that a push-in sleeve 50 protrudes over the connections 70*a*, 70*b*, 70*c* and/or that it extends just as far as the connections 70*a*, 70*b*, 70*c*. Such a push-in sleeve 50 exists in particular on a plug connector 7*a*, 9*a* that is formed as a plug. This push-in sleeve 50 surrounds a contacting space 51 in which the connections 70*a*, 70*b*, 70*c* are formed in the shape of plugs. The inner thread 50*a* of this push-in sleeve 50 comprises a protrusion 52, which may also be referred to as a tongue, and which engages with a groove 53 that is formed in the respective plug connector 7*a*, 9*a* that represents the female connector.

In the embodiment of FIGS. 11A and 11B, the groove 53 is formed on the antenna-side plug connector 9*a* whereas the protrusion 52, which is also referred to as a tongue, is formed on the module-side plug connector 7*a* of the electronic and/or filter module 4. The protrusion 52 preferably engages with the corresponding groove 53 before the plug connection is created by means of the connections 70*a*, 70*b*, 70*c* of the two plug connectors 7*a*, 9*a*.

It should be emphasized once again that the retaining and/or fastening frame 10 together with the (im)movable plug connector receiving sleeve 12, 20 may also be arranged and/or formed so that the retaining and/or fastening frame 10 is arranged on or in the electronic and/or filter module 4. In this case, the (im)movable plug connector receiving sleeve 12, 20 comprises the connection port 6*a*, 6*b* and/or the module-side plug connector 7*a*, 7*b* and may accommodate the antenna-side plug connector 9*a*, 9*b*.

The electronic and/or filter module 4 is generally an add-on module having active and/or passive components.

The movable plug connector receiving sleeve 12, 20 is preferably arranged either in part or entirely outside a further accommodating space (e.g., another sleeve).

The movable plug connector sleeve 12, 20 is preferably fastened to the frame carrier 11 exclusively in the region of its first end side 12*a* of its encircling housing wall 14. The fastening is therefore closer to the first end side 12*a* on which the insertion opening is arranged than its second end side 12*b* (sleeve bottom side). The fastening occurs in particular in the first half or in the first third or quarter or fifth of the length of the plug connector receiving sleeve 12, 20 beginning from its first end side 12*a*. The second end side 12*b* is, in particular, free from a fastening device and/or a play compensation device 16.

A movement of the plug connector receiving sleeve 12, 20 leads at the same time to a movement of the antenna-side plug connector 9*a* or of the connection port 6*a* and/or the module-side plug connector 7*a* of the electronic and/or filter module 4, which are arranged in the accommodating space 15 of the plug connector receiving sleeve 12, 20.

The plug connector receiving sleeve 12, 20 is preferably arranged exclusively outside the antenna housing 2.

The plug connector receiving sleeve 12, 20 has a preferably constant inner diameter along its longitudinal axis. The at least partially encircling housing wall 14 preferably runs through the plug connector receiving sleeve 12, 20 (without inclination) parallel to the longitudinal axis 13 and preferably has a constant diameter.

The invention is not limited to the embodiments described. All the features described and/or drawn may be combined with one another in any way within the context of the invention.

The invention claimed is:

1. A retaining and/or fastening frame, which is formed or can be fastened to or in a mobile-communications antenna and/or to an electronic and/or filter module, the frame comprising:

a frame carrier;

at least one movable plug connector receiving sleeve, which comprises a housing wall encircling a longitudinal axis of the movable plug connector receiving sleeve at least in part, and has two end sides located opposite one another, wherein the first end side is a sleeve insertion opening and the opposite second end side is the sleeve bottom side;

the encircling housing wall surrounding an accommodating space at least in part a) in which an antenna-side plug connector is or can be arranged, wherein the accommodating space is used to accommodate a connection port and/or a module-side plug connector of an electronic and/or filter module; or b) in which a connection port and/or a module-side plug connector of an electronic and/or filter module is or can be arranged, wherein the accommodating space is used to accommodate an antenna-side plug connector;

a play compensation device, wherein the movable plug connector receiving sleeve is connected directly or indirectly to the frame carrier by means of the play compensation device and permitting some play, wherein the movable plug connector receiving sleeve is movable at least in a direction transverse to the longitudinal axis relative to the frame carrier, wherein:

the play compensation device comprises a suspension device and a fastening device;

the suspension device is connected to the frame carrier in one piece or molded to it;

the fastening device is arranged on or molded to the encircling housing wall of the movable plug connector receiving sleeve;

the suspension device comprises at least two retaining portions which are located at a distance from each other, thereby creating a space;

the movable plug connector receiving sleeve is arranged in the space;

the retaining portions each comprise a retaining clip; and the fastening device comprises at least two fastening clips, wherein each fastening clip is positioned on a retaining clip and permits some play.

2. The retaining and/or fastening frame according to claim 1, wherein:

every fastening clip of the fastening device comprises an opening having a first diameter or a first opening size;

the retaining clips of the retaining portions comprise an opening having a second diameter or a second opening size;

the frame further comprises a first screw connection which penetrates the opening of the first fastening clip and the opening of the first retaining clip, and a second screw connection which penetrates the opening of the second fastening clip and the opening of the second retaining clip;

a diameter or a thickness of the first and/or second screw connection is smaller in the region of the opening of the respective fastening clips than the first diameter or the first opening size of the respective fastening clips, wherein these are positioned on the respective retaining clip and/or on the first and/or second screw connector with some play.

3. The retaining and/or fastening frame according to claim 1, wherein:

the movable plug connector receiving sleeve comprises at least one portion that runs in the direction of the longitudinal axis to the first end side, in which the outer diameter and/or the inner diameter of the movable plug connector receiving sleeve increases.

4. A retaining and/or fastening frame, which is formed or can be fastened to or in a mobile-communications antenna and/or to an electronic and/or filter module, the frame comprising:

a frame carrier;

at least one movable plug connector receiving sleeve, which comprises a housing wall encircling a longitudinal axis of the movable plug connector receiving sleeve at least in part, and has two end sides located opposite one another, wherein the first end side is a sleeve insertion opening and the opposite second end side is the sleeve bottom side;

the encircling housing wall surrounding an accommodating space at least in part a) in which an antenna-side plug connector is or can be arranged, wherein the accommodating space is used to accommodate a connection port and/or a module-side plug connector of an electronic and/or filter module; or b) in which a connection port and/or a module-side plug connector of an electronic and/or filter module is or can be arranged, wherein the accommodating space is used to accommodate an antenna-side plug connector;

a play compensation device, wherein the movable plug connector receiving sleeve is connected directly or indirectly to the frame carrier by means of the play compensation device and permitting some play, wherein the movable plug connector receiving sleeve is movable at least in a direction transverse to the longitudinal axis relative to the frame carrier, wherein:

the movable plug connector receiving sleeve comprises at least one or at least two or at least three receiving slots which extend at least across part of the length of the movable plug connector receiving sleeve and run parallel or, with one component, substantially parallel to the longitudinal axis;

the receiving slots are formed to guide the connection port and/or the module-side plug connector of the electronic and/or filter module, wherein protrusions at a peripheral wall of the connection port and/or of the module-side plug connector of the electronic and/or filter module engage or can engage in said receiving slots;

and/or the receiving slots are formed to guide the antenna-side plug connector and/or a length compensator, wherein protrusions at a peripheral wall of the antenna-side plug connector and/or of the length compensator engage or can engage in said receiving slots.

5. The retaining and/or fastening frame according to claim 4, wherein:

the receiving slots extend to the first end side of the movable plug connector receiving sleeve and are accessible from the insertion opening and end at a distance from the second end side or extend to the second end side;

and/or the receiving slots widen toward the first end side and act as a centering aid.

6. A retaining and/or fastening frame, which is formed or can be fastened to or in a mobile-communications antenna and/or to an electronic and/or filter module, the frame comprising:

a frame carrier;

at least one movable plug connector receiving sleeve, which comprises a housing wall encircling a longitudinal axis of the movable plug connector receiving sleeve at least in part, and has two end sides located opposite one another, wherein the first end side is a sleeve insertion opening and the opposite second end side is the sleeve bottom side;

the encircling housing wall surrounding an accommodating space at least in part a) in which an antenna-side plug connector is or can be arranged, wherein the accommodating space is used to accommodate a connection port and/or a module-side plug connector of an electronic and/or filter module; or b) in which a connection port and/or a module-side plug connector of an electronic and/or filter module is or can be arranged, wherein the accommodating space is used to accommodate an antenna-side plug connector;

a play compensation device, wherein the movable plug connector receiving sleeve is connected directly or indirectly to the frame carrier by means of the play compensation device and permitting some play, wherein the movable plug connector receiving sleeve is movable at least in a direction transverse to the longitudinal axis relative to the frame carrier, wherein:

the movable plug connector receiving sleeve comprises at least one or at least two or at least three guiding ridges which are arranged on an inner wall of the encircling housing wall and protrude radially into the accommodating space and which extend at least across part of the length of the movable plug connector receiving sleeve and run parallel or, with one component, substantially parallel to the longitudinal axis;

the guiding ridges are formed to guide the connection port and/or the module-side plug connector of the electronic and/or filter module, wherein the guiding ridges engage or can engage in grooves on a peripheral wall of the connection port and/or the module-side plug connector of the electronic and/or filter module;

and/or the guiding ridges are formed to guide the antenna-side plug connector and/or a length compensator, wherein the guiding ridges engage or can engage in grooves on a peripheral wall of the antenna-side plug connector and/or of the length compensator.

7. The retaining and/or fastening frame according to claim 6, wherein:

the guiding ridges extend to the first end side of the movable plug connector receiving sleeve and are accessible from the insertion opening and end at a distance from the second end side or extend to the second end side; and/or the guiding ridges taper toward the first end side and act as a centering aid.

8. The retaining and/or fastening frame according to claim 1, wherein:

the play permits a movement of the movable plug connector receiving sleeve relative to the frame carrier with a movement vector, wherein the movement vector runs in a plane that is vertical to the longitudinal axis, wherein the movement occurs across a length that is smaller than 2 cm or 1.5 cm or 1 cm or 0.8 cm or 0.6 cm or 0.4 cm or 0.2 cm or 0.1 cm but greater than 0.05 cm or 0.1 cm or 0.2 cm or 0.3 cm or 0.5 cm or 0.7 cm; and/or the play allows for an inclination of the movable plug connector receiving sleeve relative to the frame carrier and or a rotation of the movable plug connector receiving sleeve, wherein the movable plug connector receiving sleeve can incline and/or rotate by less than 10° or 8° or 6° or 4° or 2° or less than 1° but by more than 0.1° or 0.2° or 0.5° or 1.5° or 3° or 5° or more than 7° relative to the frame carrier.

9. A retaining and/or fastening frame, which is formed or can be fastened to or in a mobile-communications antenna and/or to an electronic and/or filter module, the frame comprising:

a frame carrier;

at least one movable plug connector receiving sleeve, which comprises a housing wall encircling a longitudinal axis of the movable plug connector receiving sleeve at least in part, and has two end sides located opposite one another, wherein the first end side is a sleeve insertion opening and the opposite second end side is the sleeve bottom side;

the encircling housing wall surrounding an accommodating space at least in part a) in which an antenna-side plug connector is or can be arranged, wherein the accommodating space is used to accommodate a connection port and/or a module-side plug connector of an electronic and/or filter module; or b) in which a connection port and/or a module-side plug connector of an electronic and/or filter module is or can be arranged, wherein the accommodating space is used to accommodate an antenna-side plug connector;

a play compensation device, wherein the movable plug connector receiving sleeve is connected directly or indirectly to the frame carrier by means of the play compensation device and permitting some play, wherein the movable plug connector receiving sleeve is movable at least in a direction transverse to the longitudinal axis relative to the frame carrier; and at least one length compensator comprising a front end side and a back end side, wherein the at least one length compensator is arranged in the accommodating space of the movable plug connector receiving sleeve at its second end side and is formed so that the antenna-side or module-side plug connector that is or can be arranged in the accommodating space is movable along the longitudinal axis in the direction of the second end side or away from the second end side.

10. The retaining and/or fastening frame according to claim 1, further including at least one further movable plug connector receiving sleeve;

wherein the movable plug connector sleeves are, when looking at the insertion openings from above:

a) arranged so that they are laterally offset against each other, or b) arranged so that they are laterally and consecutively offset against each other.

11. The retaining and/or fastening frame according to claim 1, further including:

an immovable plug connector receiving sleeve;

the immovable plug connector sleeve being connected to the frame carrier in a fixed manner without play;

wherein the immovable plug connector receiving sleeve comprises two opposite end sides, wherein a first end side is the sleeve insertion opening and the opposite second end side is the sleeve bottom side of the immovable plug connector receiving sleeve;

a partially encircling housing wall of the immovable plug connector receiving sleeve surrounding an accommodating space, wherein in the accommodating space a) a further antenna-side plug connector is or can be arranged and the accommodating space is used to accommodate a further connection port and/or further module-side plug connectors of the electronic and/or filter module; or b) a further connection port and/or a further module-side plug connector of the electronic and/or filter module is or can be arranged and the accommodating space is used to accommodate a further antenna-side plug connector;

the sleeve insertion opening of the immovable plug connector receiving sleeve is used to receive a) a further connection port and/or a further module-side plug connector of the electronic and/or filter module; or b) a further antenna-side plug connector;

the immovable plug connector receiving sleeve and the at least one movable plug connector receiving sleeve are, when looking at the insertion openings from above:

a) arranged so that they are laterally offset against each other, or b) arranged so that they are laterally and consecutively offset against each other.

12. The retaining and/or fastening frame according to claim 1, wherein:

the antenna-side plug connector or the module-side plug connector are arranged in the accommodating space of the movable plug connector receiving sleeve;

the antenna-side plug connector or the module-side plug connector comprises at least one or at least two or at least three connections, wherein the at least one connection or the connections are formed as:

a) coaxial connections having an inner conductor and an outer conductor, and/or b) pin contacts or tongue contacts or female connector contacts; and/or c) optical interfaces; and/or d) capacitive couplings;

the antenna-side plug connector or the module-side plug connector comprises the shape of a female connector or a plug.

13. The retaining and/or fastening frame according to claim 12, wherein:

the antenna-side plug connector or the module-side plug connector comprises a centering device which is arranged in particular in the center of the antenna-side plug connector or the module-side plug connector;

the centering device has the shape of a centering opening or a centering pin and is formed to engage in a corresponding centering device in the module-side plug connector or in the antenna-side plug connector that has the corresponding shape of the centering pin or the centering opening, wherein both centering devices are already in engagement before the plug connection engages with the antenna-side plug connector and the module-side plug connector.

14. The retaining and/or fastening frame according to claim 12, wherein:

the antenna-side plug connector or the module-side plug connector comprises a protrusion or a groove, wherein the protrusion or the groove can engage with a groove or a protrusion, which are formed on the module-side plug connector or the antenna-side plug connector.

15. The retaining and/or fastening frame according to claim 14, wherein:

the antenna-side plug connector or the module-side plug connector comprises a push-in sleeve that protrudes beyond the connections in the longitudinal direction; and the protrusion is formed on an inner wall thread of this socket.

16. A mobile-communications antenna for fastening to a mast or wall-shaped carrier, the mobile-communication antenna comprising:

at least one or more retaining and/or fastening frames comprising a frame carrier, at least one movable plug connector receiving sleeve, which comprises a housing wall encircling a longitudinal axis of the movable plug connector receiving sleeve at least in part, and has two end sides located opposite one another, wherein the first end side is a sleeve insertion opening and the opposite second end side is the sleeve bottom side, the encircling housing wall surrounding an accommodating space at least in part a) in which an antenna-side plug connector is or can be arranged, wherein the accommodating space is used to accommodate a connection port and/or a module-side plug connector of an electronic and/or filter module, or b) in which a connection port and/or a module-side plug connector of an electronic and/or filter module is or can be arranged, wherein the accommodating space is used to accommodate an antenna-side plug connector, a play compensation device, wherein the movable plug connector receiving sleeve is connected directly or indirectly to the frame carrier by means of the play compensation device and permitting some play, wherein the movable plug connector receiving sleeve is movable at least in a direction transverse to the longitudinal axis relative to the frame carrier;

one or more electronic and/or filter modules;

at least one antenna housing having a housing front side, a housing back side, and a first and a second lateral housing side arranged opposite each other which together form a surrounding housing wall, wherein the antenna housing extends along a longitudinal axis;

a plurality of emitters or emitter pairs which are arranged in the antenna housing at a distance from at least one reflector;

at least one or more retaining and/or fastening frames are mounted on the antenna housing or on the one or more electronic and/or filter modules; and an antenna-side plug connector or a module-side plug connector is arranged in the accommodating space of the at least one movable plug connector receiving sleeve.

17. The mobile-communications antenna according to claim 16, further including:

a further antenna-side plug connector or a further module-side plug connector is arranged in the accommodating space of the immovable plug connector receiving sleeve.

18. The mobile-communications antenna according to claim 16, wherein:

the at least one or the at least two electronic and/or filter modules comprise:

a) at least a first connection port having a module-side first plug connector arranged within and/or on the first connection port; or b) at least a first and at least a second connection port, wherein a module-side plug connector is arranged in and/or on at least both connection ports;

the at least one electronic and/or filter module or the at least two electronic and/or filter modules are each fastened to or mounted on a shared retaining and/or fastening frame and accordingly on the housing back side and/or on the first or second lateral housing side outside the antenna housing;

the at least one connection port and/or the module-side plug connector project into the accommodation space of the movable plug connector receiving sleeve; or the at least one connection port and/or the module-side plug connector project into the accommodating space of the movable plug connector receiving sleeve, and the at least one further connection port and/or the further module-side plug connector project into the accommodating space of the immovable plug connector receiving sleeve:

a first plug connection is formed by the module-side plug connector and the antenna-side plug connector in the accommodating space of the movable plug connector receiving sleeve; or a first plug connection is formed by the module-side plug connector and the antenna-side plug connector in the accommodating space of the movable plug connector receiving sleeve, and a second plug connection is formed by the further module-side plug connector and the further antenna-side plug connector in the accommodating space of the immovable plug connector sleeve.

19. The mobile-communications antenna according to claim 16, wherein:

the at least one electronic and/or filter module comprises an amplifier and/or a signal-processing unit and/or a control unit and/or a power supply unit and/or a filter and/or coupler.

* * * * *